US009602947B2

(12) United States Patent
Oh et al.

(10) Patent No.: US 9,602,947 B2
(45) Date of Patent: Mar. 21, 2017

(54) APPARATUS AND A METHOD FOR PROCESSING AUDIO SIGNAL TO PERFORM BINAURAL RENDERING

(71) Applicant: GAUDI AUDIO LAB, INC., Seoul (KR)

(72) Inventors: Hyunoh Oh, Seongnam-si (KR); Taegyu Lee, Seoul (KR); Yonghyun Baek, Seoul (KR)

(73) Assignee: GAUDI AUDIO LAB, INC., Seoul (KR)

( * ) Notice: Subject to any disclaimer, the term of this patent is extended or adjusted under 35 U.S.C. 154(b) by 0 days.

(21) Appl. No.: 15/012,841

(22) Filed: Feb. 1, 2016

(65) Prior Publication Data

US 2016/0227338 A1 Aug. 4, 2016

(30) Foreign Application Priority Data

Jan. 30, 2015 (KR) ..... 10-2015-0015566
Aug. 18, 2015 (KR) ..... 10-2015-0116374

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 2400/11* (2013.01); *H04S 2420/01* (2013.01)

(58) Field of Classification Search
None
See application file for complete search history.

(56) References Cited

U.S. PATENT DOCUMENTS

2008/0008342 A1 1/2008 Sauk
2008/0031462 A1* 2/2008 Walsh ..... H04S 3/02 381/17

(Continued)

FOREIGN PATENT DOCUMENTS

JP 2015-019360 A 1/2015
KR 10-2010-0049555 A 5/2010

(Continued)

OTHER PUBLICATIONS

Korean Office Action in Appl. No. 10-2016-0012575 dated Mar. 30, 2016 with English translation.

*Primary Examiner* — Paul Huber
(74) *Attorney, Agent, or Firm* — Park, Kim & Suh, LLC

(57) ABSTRACT

The present invention relates to an audio signal processing apparatus and an audio signal processing method which perform binaural rendering.
The present invention provides an audio signal processing apparatus which performs binaural filtering on an input audio signal, including: a direction renderer which localizes a direction of a sound source of the input audio signal and a distance renderer which reflects an effect in accordance with a distance between the sound source of the input audio signal and a listener, in which the distance renderer obtains information on a distance (an ipsilateral distance) and an incident angle (an ipsilateral incident angle) of the sound source with respect to an ipsilateral ear of the listener and information on a distance (a contralateral distance) and an incident angle (a contralateral incident angle) of the sound source with respect to a contralateral ear of the listener, determines an ipsilateral distance filter based on at least one of the obtained information of the ipsilateral distance and the ipsilateral incident angle, determines a contralateral distance filter based on at least one of the obtained information of the contralateral distance and the contralateral incident angle, (Continued)

and filters the input audio signal with the determined ipsilateral distance filer and contralateral distance filter, respectively, to generate an ipsilateral output signal and a contralateral output signal.

12 Claims, 13 Drawing Sheets

(56) References Cited

U.S. PATENT DOCUMENTS

| | | | | |
|---|---|---|---|---|
| 2008/0033730 | A1 | 2/2008 | Jot et al. | |
| 2008/0273721 | A1* | 11/2008 | Walsh | H04S 5/00 381/300 |
| 2009/0262947 | A1* | 10/2009 | Karlsson | H04S 7/30 381/17 |
| 2012/0121092 | A1 | 5/2012 | Starobin | |
| 2013/0163766 | A1* | 6/2013 | Choueiri | H04R 3/04 381/17 |

FOREIGN PATENT DOCUMENTS

| | | | |
|---|---|---|---|
| KR | 10-2010-0083477 | A | 7/2010 |
| KR | 10-2013-0010893 | A | 1/2013 |

* cited by examiner

APPARATUS AND A METHOD FOR PROCESSING AUDIO SIGNAL TO PERFORM BINAURAL RENDERING

CROSS-REFERENCE TO RELATED APPLICATIONS

This application claims priority to and the benefit of Korean Patent Application No. 10-2015-0015566 filed in the Korean Intellectual Property Office on Jan. 30, 2015, and Korean Patent Application No. 10-2015-0116374 filed in the Korean Intellectual Property Office on Aug. 18, 2015, the entire contents of which are incorporated herein by reference.

TECHNICAL FIELD

The present invention relates to an audio signal processing apparatus and an audio signal processing method which perform binaural rendering.

BACKGROUND ART 3D audio collectively refers to a series of signal processing, transmitting, coding, and reproducing technologies which provide another axis corresponding to a height direction to a sound scene on a horizontal surface (2D) which is provided from surrounding audio of the related art to provide sound having presence in a three dimensional space. Specifically, in order to provide 3D audio, a larger number of speakers need to be used as compared than the related art or a rendering technique which forms a sound image in a virtual position where no speaker is provided even though a small number of speakers are used is required.

The 3D audio may be an audio solution corresponding to an ultra high definition TV (UHDTV) and is expected to be used in various fields and devices. There are channel based signals and object based signals as a sound source which is provided to the 3D audio. In addition, there may be a sound source in which the channel based signals and the object based signals are mixed and thus a user may have a new type of listening experience.

Meanwhile, the binaural rendering is a processing which models an input audio signal as a signal which is transferred to both ears of a human. The user could feel a 3D sound effect by listening to two channel output audio signals which are binaurally rendered through a headphone or an earphone. Therefore, when the 3D audio is modeled as an audio signal which is transferred to the ears of a human, a 3D sound effect of 3D audio may be reproduced through two channel output audio signals.

SUMMARY OF THE INVENTION

The present invention has been made in an effort to provide an audio signal processing apparatus and an audio signal processing method which perform binaural rendering.

The present invention has also been made in an effort to perform efficient binaural rendering on object signals and channel signals of 3D audio.

The present invention has also been made in an effort to implement immersive binaural rendering on audio signals of virtual reality (VR) contents.

In order to obtain the above object, the present invention provides an audio signal processing method and an audio signal processing apparatus as follows.

An exemplary embodiment of the present invention provides an audio signal processing apparatus which performs binaural filtering on an input audio signal, including: a first filtering unit which filters the input audio signal by a first lateral transfer function to generate a first lateral output signal; and a second filtering unit which filters the input audio signal by a second lateral transfer function to generate a second lateral output signal, in which the first lateral transfer function and the second lateral transfer function may be generated by modifying an interaural transfer function (ITF) obtained by dividing a first lateral head related transfer function (HRTF) by a second HRTF with respect to the input audio signal.

The first lateral transfer function and the second lateral transfer function may be generated by modifying the ITF based on a notch component of at least one of the first lateral HRTF and the second lateral HRTF with respect to the input audio signal.

The first lateral transfer function may be generated based on the notch component extracted from the first lateral HRTF and the second lateral transfer function may be generated based on a value obtained by dividing the second lateral HRTF by an envelope component extracted from the first lateral HRTF.

The first lateral transfer function may be generated based on the notch component extracted from the first lateral HRTF and the second lateral transfer function may be generated based on a value obtained by dividing the second lateral HRTF by an envelope component extracted from the first lateral HRTF which has a different direction from the input audio signal.

The first lateral HRTF having the different direction may have the same azimuth as the input audio signal and an altitude of zero.

The first lateral transfer function may be a finite impulse response (FIR) filter coefficient or an infinite impulse response (IIR) filter coefficient generated using a notch component of the first lateral HRTF.

The second lateral transfer function may include an interaural parameter generated based on an envelope component of a first lateral HRTF and an envelope component of a second lateral HRTF with respect to the input audio signal and an impulse response (IR) filter coefficient generated based on the notch component of the second lateral HRTF, and the first lateral transfer function may include an IR filter coefficient generated based on the notch component of the first lateral HRTF.

The interaural parameter includes an interaural level difference (ILD) and an interaural time difference (ITD).

Next, another exemplary embodiment of the present invention provides an audio signal processing apparatus which performs binaural filtering on an input audio signal, including an ipsilateral filtering unit which filters the input audio signal by an ipsilateral transfer function to generate an ipsilateral output signal; and a contralateral filtering unit which filters the input audio signal by a contralateral transfer function to generate a contralateral output signal, in which the ipsilateral and contralateral transfer functions are generated based on different transfer functions in a first frequency band and a second frequency band.

The ipsilateral and contralateral transfer functions of the first frequency band may be generated based on the interaural transfer function (ITF) and the ITF may be generated based on a value obtained by dividing the ipsilateral head related transfer function (HRTF) by the contralateral HRTF with respect to the input audio signal.

The ipsilateral and contralateral transfer functions of the first frequency band may be an ipsilateral HRTF and a contralateral HRTF with respect to the input audio signal.

The ipsilateral and contralateral transfer functions of the second frequency band which is different from the first frequency band may be generated based on a modified interaural transfer function (MITF) and the MITF may be generated by modifying the interaural transfer function (ITF) based on a notch component of at least one of the ipsilateral HRTF and the contralateral HRTF with respect to the input audio signal.

The ipsilateral transfer function of the second frequency band may be generated based on a notch component extracted from the ipsilateral HRTF and the contralateral transfer function of the second frequency band may be generated based on a value obtained by dividing the contralateral HRTF by an envelope component extracted from the ipsilateral HRTF.

The ipsilateral and contralateral transfer functions of the first frequency band may be generated based on information extracted from at least one of an interaural level difference (ILD), an interaural time difference (ITD), an interaural phase difference (IPD), and an interaural coherence (IC) for each frequency band of the ipsilateral HRTF and the contralateral HRTF with respect to the input audio signal.

The transfer functions of the first frequency band and the second frequency band may be generated based on information extracted from the same ipsilateral and contralateral HRTFs.

The first frequency band may be lower than the second frequency band.

The ipsilateral and contralateral transfer functions of the first frequency band may be generated based on a first transfer function and the ipsilateral and contralateral transfer functions of the second frequency band which is different from the first frequency band may be generated based on a second transfer function, and the ipsilateral and contralateral transfer functions in a third frequency band between the first frequency band and the second frequency band may be generated based on a linear combination of the first transfer function and the second transfer function.

Furthermore, an exemplary embodiment of the present invention provides an audio signal processing method which performs binaural filtering on an input audio signal, including: receiving an input audio signal; filtering the input audio signal by an ipsilateral transfer function to generate an ipsilateral output signal; and filtering the input audio signal by a contralateral transfer function to generate a contralateral output signal, in which the ipsilateral and contralateral transfer functions are generated based on different transfer functions in a first frequency band and a second frequency band.

Another exemplary embodiment of the present invention provides an audio signal processing method which performs binaural filtering on an input audio signal, including: receiving an input audio signal; filtering the input audio signal by a first transfer function to generate a first output signal; and filtering the input audio signal by a second lateral transfer function to generate a second output signal, in which the first lateral transfer function and the second lateral transfer function may be generated by modifying an interaural transfer function (ITF) obtained by dividing a first lateral head related transfer function (HRTF) by a second lateral HRTF with respect to the input audio signal.

Next, still another exemplary embodiment of the present invention provides an audio signal processing apparatus which performs binaural filtering on an audio signal, including: a direction renderer which localizes a direction of a sound source of the input audio signal; and a distance renderer which reflects an effect in accordance with a distance between the sound source of the input audio signal and a listener, in which the distance renderer obtains information on a distance (an ipsilateral distance) and an incident angle (an ipsilateral incident angle) of the sound source with respect to an ipsilateral ear of the listener and information on a distance (a contralateral distance) and an incident angle (a contralateral incident angle) of the sound source with respect to a contralateral ear of the listener, determines an ipsilateral distance filter based on at least one of the obtained information of the ipsilateral distance and the ipsilateral incident angle, determines a contralateral distance filter based on at least one of the obtained information of the contralateral distance and the contralateral incident angle, and filters the input audio signal with the determined ipsilateral distance filer and the contralateral distance filter, respectively, to generate an ipsilateral output signal and a contralateral output signal.

The ipsilateral distance filter may adjust at least one of the gain and the frequency characteristics of the ipsilateral output signal and the contralateral distance filter may adjust at least one of the gain and the frequency characteristics of the contralateral output signal.

The ipsilateral distance filter may be a low shelving filter and the contralateral distance filter may be a low pass filter.

The ipsilateral distance, the ipsilateral incident angle, the contralateral distance, and the contralateral incident angle may be obtained based on relative position information of the sound source with respect to a center of a head of the listener and head size information of the listener.

The distance renderer may perform the filtering using the ipsilateral distance filter and the contralateral distance filter when a distance between the listener and the sound source is within a predetermined distance.

The direction renderer may select an ipsilateral direction filter based on the ipsilateral incident angle, select a contralateral direction filter based on the contralateral incident angle, and filter the input audio signal using the selected ipsilateral direction filter and contralateral direction filter.

The ipsilateral direction filter and the contralateral direction filter may be selected from head related transfer function (HRTF) sets corresponding to different positions, respectively.

When the relative position information of the sound source with respect to the center of the head of the listener is changed, the direction renderer may additionally compensate for a notch component of at least one of the ipsilateral direction filter and the contralateral direction filter corresponding to the changed position.

The ipsilateral incident angle may include an azimuth (an ipsilateral azimuth) and an altitude (an ipsilateral altitude) of the sound source with respect to the ipsilateral ear and the contralateral incident angle may include an azimuth (a contralateral azimuth) and an altitude (a contralateral altitude) of the sound source with respect to the contralateral ear, and the direction renderer may select the ipsilateral direction filter based on the ipsilateral azimuth and the ipsilateral altitude and select the contralateral direction filter based on the contralateral azimuth and the contralateral altitude.

The direction renderer may obtain head rotation information of the listener and the head rotation information of the listener may include information on at least one of yaw, roll and pitch of the head of the listener, calculate change of the ipsilateral incident angle and the contralateral incident angle based on the head rotation information of the listener, and select the ipsilateral direction filter and the contralateral direction filter based in the changed ipsilateral incident angle and contralateral incident angle.

When the head of the listener rolls, any one of the ipsilateral altitude and the contralateral altitude may be increased and the other one may be decreased, and the direction renderer may select the ipsilateral direction filter and the contralateral direction filter based on the changed ipsilateral altitude and contralateral altitude.

Furthermore, still another exemplary embodiment of the present invention provides an audio signal processing method which performs binaural filtering on an input audio signal, including: obtaining information on a distance (an ipsilateral distance) and an incident angle (an ipsilateral incident angle) of a sound source with respect to an ipsilateral ear of a listener; obtaining information on a distance (a contralateral distance) and an incident angle (a contralateral incident angle) of the sound source with respect to a contralateral ear of the listener; determining an ipsilateral distance filter based on at least one of the obtained information of the ipsilateral distance and the ipsilateral incident angle; determining a contralateral distance filter based on at least one of the obtained information of the contralateral distance and the contralateral incident angle; filtering the input audio signal by the determined ipsilateral distance filter to generate an ipsilateral output signal; and filtering the input audio signal by the determined contralateral distance filter to generate a contralateral output signal.

According to an exemplary embodiment of the present invention, a high quality binaural sound may be provided with low computational complexity.

According to the exemplary embodiment, deterioration of a sound image localization and degradation of a sound quality which may be caused by the binaural rendering may be prevented.

According to the exemplary embodiment of the present invention, binaural rendering process to which a motion of a user or an object is reflected is allowed through an efficient calculation.

DETAILED DESCRIPTION

Terminologies used in the specification are selected from general terminologies which are currently and widely used as much as possible while considering a function in the present invention, but the terminologies may vary in accordance with the intention of those skilled in the art, custom, or appearance of new technology. Further, in particular cases, the terminologies are arbitrarily selected by an applicant and in this case, the meaning thereof may be described in a corresponding section of the description of the invention. Therefore, it is noted that the terminology used in the specification is analyzed based on a substantial meaning of the terminology and the whole specification rather than a simple title of the terminology.

Figure 1:
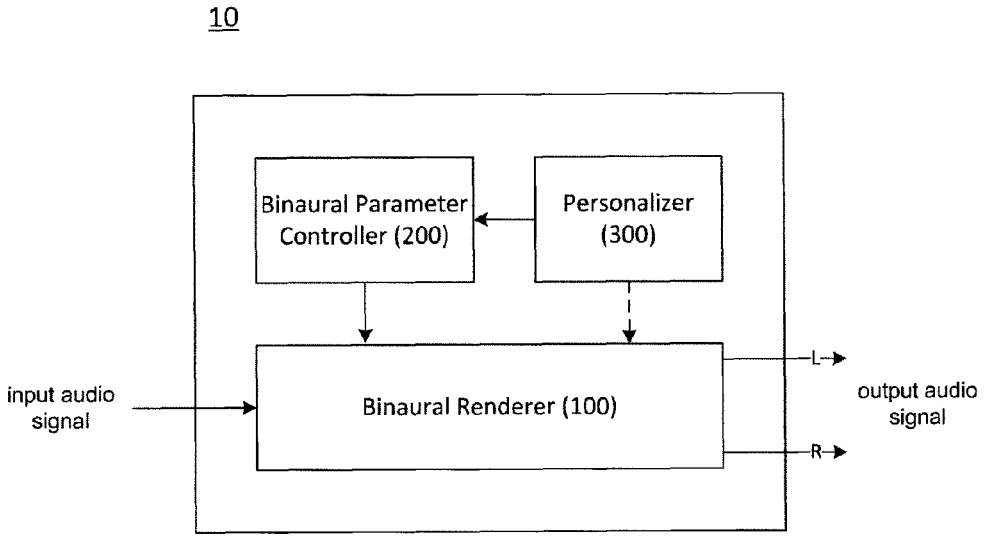
FIG. 1 is a block diagram illustrating an audio signal processing apparatus according to an exemplary embodiment of the present invention.

FIG. 1 is a block diagram illustrating an audio signal processing apparatus according to an exemplary embodiment of the present invention. Referring to FIG. 1, an audio signal processing apparatus 10 includes a binaural renderer 100, a binaural parameter controller 200, and a personalizer 300.

First, the binaural renderer 100 receives input audio and performs binaural rendering on the input audio to generate two channel output audio signals L and R. An input audio signal of the binaural renderer 100 may include at least one of an object signal and a channel signal. In this case, the input audio signal may be one object signal or one mono signal or may be multi object signals or multi channel signals. According to an exemplary embodiment, when the binaural renderer 100 includes a separate decoder, the input signal of the binaural renderer 100 may be a coded bitstream of the audio signal.

An output audio signal of the binaural renderer 100 is a binaural signal, that is, two channel audio signals in which each input object/channel signal is represented by a virtual sound source located in a 3D space. The binaural rendering is performed based on a binaural parameter provided from the binaural parameter controller 200 and performed on a time domain or a frequency domain. As described above, the binaural renderer 100 performs binaural rendering on various types of input signals to generate a 3D audio headphone signal (that is, 3D audio two channel signals).

According to an exemplary embodiment, post processing may be further performed on the output audio signal of the binaural renderer 100. The post processing includes cross-talk cancellation, dynamic range control (DRC), volume normalization, and peak limitation. The post processing may further include frequency/time domain converting on the output audio signal of the binaural renderer 100. The audio signal processing apparatus 10 may include a separate post processor which performs the post processing and according to another exemplary embodiment, the post processor may be included in the binaural renderer 100.

The binaural parameter controller 200 generates a binaural parameter for the binaural rendering and transfers the binaural parameter to the binaural renderer 100. In this case, the transferred binaural parameter includes an ipsilateral transfer function and a contralateral transfer function, as described in the following various exemplary embodiments. In this case, the transfer function may include at least one of a head related transfer function (HRTF), an interaural transfer function (ITF), a modified ITF (MITF), a binaural room transfer function (BRTF), a room impulse response (RIR), a binaural room impulse response (BRIR), a head related impulse response (HRIR), and modified/edited data thereof, but the present invention is not limited thereto.

The transfer function may be measured in an anechoic room and include information on HRTF estimated by a simulation. A simulation technique which is used to estimate the HRTF may be at least one of a spherical head model (SHM), a snowman model, a finite-difference time-domain method (FDTDM), and a boundary element method (BEM). In this case, the spherical head model indicates a simulation technique which performs simulation on the assumption that a head of a human is a sphere. Further, the snowman model indicates a simulation technique which performs simulation on the assumption that a head and a body are spheres.

The binaural parameter controller 200 obtains the transfer function from a database (not illustrated) or receives a personalized transfer function from the personarizer 300. In the present invention, it is assumed that the transfer function is obtained by performing fast Fourier transform on an impulse response (IR), but a transforming method in the present invention is not limited thereto. That is, according to the exemplary embodiment of the present invention, the transforming method includes a quadratic mirror filterbank (QMF), discrete cosine transform (DCT), discrete sine transform (DST), and wavelet.

According to the exemplary embodiment of the present invention, the binaural parameter controller 200 generates the ipsilateral transfer function and the contralateral transfer function and transfers the generated transfer functions to the binaural renderer 100. According to the exemplary embodiment, the ipsilateral transfer function and the contralateral transfer function may be generated by modifying an ipsilateral prototype transfer function and a contralateral prototype transfer function, respectively. Further, the binaural parameter may further include an interaural level difference (ILD), interaural time difference (ITD), finite impulse response (FIR) filter coefficients, and infinite impulse response filter coefficients. In the present invention, the ILD and the ITD may also be referred to as an interaural parameter.

Meanwhile, in the exemplary embodiment of the present invention, the transfer function is used as a terminology which may be replaced with the filter coefficients. Further, the prototype transfer function is used as a terminology which is replaced with a prototype filter coefficients. Therefore, the ipsilateral transfer function and the contralateral transfer function may represent the ipsilateral filter coefficients and the contralateral filter coefficients, respectively, and the ipsilateral prototype transfer function and the contralateral prototype transfer function may represent the ipsilateral prototype filter coefficients and the contralateral prototype filter coefficients, respectively.

According to an exemplary embodiment, the binaural parameter controller 200 may generate the binaural parameter based on personalized information obtained from the personalizer 300. The personalizer 300 obtains additional information for applying different binaural parameters in accordance with users and provides the binaural transfer function determined based on the obtained additional information. For example, the personalizer 300 may select a binaural transfer function (for example, a personalized HRTF) for the user from the database, based on physical attribute information of the user. In this case, the physical attribute information may include information such as a shape or size of a pinna, a shape of external auditory meatus, a size and a type of a skull, a body type, and a weight.

The personalizer 300 provides the determined binaural transfer function to the binaural renderer 100 and/or the binaural parameter controller 200. According to an exemplary embodiment, the binaural renderer 100 performs the binaural rendering on the input audio signal using the binaural transfer function provided from the personalizer 300. According to another exemplary embodiment, the binaural parameter controller 200 generates a binaural parameter using the binaural transfer function provided from the personalizer 300 and transfers the generated binaural parameter to the binaural renderer 100. The binaural renderer 100 performs binaural rendering on the input audio signal based on the binaural parameter obtained from the binaural parameter controller 200.

Meanwhile, FIG. 1 is an exemplary embodiment illustrating elements of the audio signal processing apparatus 10 of the present invention, but the present invention is not limited thereto. For example, the audio signal processing apparatus 10 of the present invention may further include an additional element other than the elements illustrated in FIG. 1. Further, some elements illustrated in FIG. 1, for example, the personalizer 300 may be omitted from the audio signal processing apparatus 10.

Figure 2:
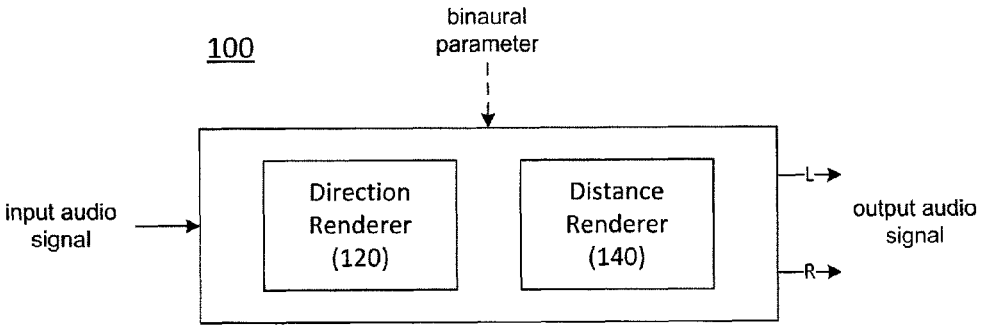
FIG. 2 is a block diagram illustrating a binaural renderer according to an exemplary embodiment of the present invention.

FIG. 2 is a block diagram illustrating a binaural renderer according to an exemplary embodiment of the present invention. Referring to FIG. 2, the binaural renderer 100 includes a direction renderer 120 and a distance renderer 140. In the exemplary embodiment of the present invention, the audio signal processing apparatus may represent the binaural renderer 100 of FIG. 2 or may indicate the direction renderer 120 or the distance renderer 140 which is a component thereof. However, in the exemplary embodiment of the present invention, an audio signal processing apparatus in a broad meaning may indicate the audio signal processing apparatus 10 of FIG. 1 which includes the binaural renderer 100.

First, the direction renderer 120 performs direction rendering to localize a direction of the sound source of the input audio signal. The sound source may represent an audio object corresponding to the object signal or a loud speaker corresponding to the channel signal. The direction renderer 120 applies a binaural cue which distinguishes a direction of a sound source with respect to a listener, that is, a direction cue to the input audio signal to perform the direction rendering. In this case, the direction cue includes a level difference of both ears, a phase difference of both ears, a spectral envelope, a spectral notch, and a peak. The direction renderer 120 performs the binaural rendering using the binaural parameter such as the ipsilateral transfer function and the contralateral transfer function.

Next, the distance renderer 140 performs distance rendering which reflects an effect in accordance with a sound source distance of the input audio signal. The distance renderer 140 applies a distance cue which distinguishes a distance of the sound source with respect to a listener to the input audio signal to perform the distance rendering. According to the exemplary embodiment of the present invention, the distance rendering may reflect a change of a sound intensity and spectral shaping in accordance with the distance change of the sound source to the input audio signal. According to the exemplary embodiment of the present invention, the distance renderer 140 performs different processings depending on whether the distance of the sound source is within a predetermined threshold value. When the distance of the sound source exceeds the predetermined threshold value, a sound intensity which is inversely proportional to the distance of the sound source with respect to the head of the listener may be applied. However, when the distance of the sound source is within the predetermined threshold value, separate distance rendering may be performed based on the distances of the sound source which are measured with respect to both ears of the listener, respectively.

According to the exemplary embodiment of the present invention, the binaural renderer 100 performs at least one of the direction rendering and the distance rendering on the input signal to generate a binaural output signal. The binaural renderer 100 may sequentially perform the direction rendering and the distance rendering on the input signal or may perform a processing in which the direction rendering and the distance rendering are combined. Hereinafter, in the exemplary embodiment of the present invention, as a concept including the direction rendering, the distance rendering, and a combination thereof, the term binaural rendering or binaural filtering may be used.

According to an exemplary embodiment, the binaural renderer 100 first performs the direction rendering on the input audio signal to obtain two channel output signals, that is, an ipsilateral output signal D^I and a contralateral output signal D^C. Next, the binaural renderer 100 performs the distance rendering on two channel output signals D^I and D^C to generate binaural output signals B^I and B^C. In this case, the input signal of the direction renderer 120 is an object signal and/or a channel signal and the input signal of the distance renderer 140 is two channel signals D^I and D^C on which the direction rendering is performed as a preprocessing step.

According to another exemplary embodiment, the binaural renderer 100 first performs the distance rendering on the input audio signal to obtain two channel output signals, that is, an ipsilateral output signal di and a contralateral output signal d^C. Next, the binaural renderer 100 performs the direction rendering on two channel output signals d^I and d^C to generate binaural output signals B^I and B^C. In this case, the input signal of the distance renderer 140 is an object signal and/or a channel signal and the input signal of the direction renderer 120 is two channel signals d^I and d^C on which the distance rendering is performed as a preprocessing step.

Figure 3:
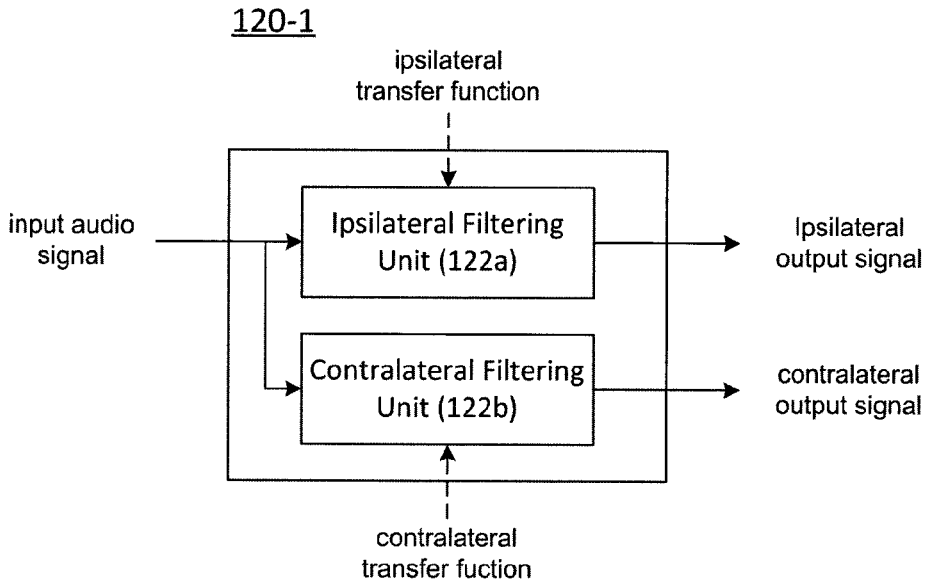
FIG. 3 is a block diagram of a direction renderer according to an exemplary embodiment of the present invention.

FIG. 3 is a block diagram of a direction renderer 120-1 according to an exemplary embodiment of the present invention. Referring to FIG. 3, the direction renderer 120-1 includes an ipsilateral filtering unit 122*a* and a contralateral filtering unit 122*b*. The direction renderer 120-1 receives a binaural parameter including an ipsilateral transfer function and a contralateral transfer function and filters the input audio signal with the received binaural parameter to generate an ipsilateral output signal and a contralateral output signal. That is, the ipsilateral filtering unit 122*a* filters the input audio signal with the ipsilateral transfer function to generate the ipsilateral output signal and the contralateral filtering unit 122*b* filters the input audio signal with the contralateral transfer function to generate the contralateral output signal. According to an exemplary embodiment of the present invention, the ipsilateral transfer function and the contralateral transfer function may be an ipsilateral HRTF and a contralateral HRTF, respectively. That is, the direction renderer 120-1 convolutes the input audio signal with the HRTFs for both ears to obtain the binaural signal of the corresponding direction.

In an exemplary embodiment of the present invention, the ipsilateral/contralateral filtering units 122*a* and 122*b* may indicate left/right channel filtering units respectively, or right/left channel filtering units respectively. When the sound source of the input audio signal is located at a left side of the listener, the ipsilateral filtering unit 122*a* generates a left channel output signal and the contralateral filtering unit 122*b* generates a right channel output signal. However, when the sound source of the input audio signal is located at a right side of the listener, the ipsilateral filtering unit 122*a* generates a right channel output signal and the contralateral filtering unit 122*b* generates a left channel output signal. As described above, the direction renderer 120-1 performs the ipsilateral/contralateral filtering to generate left/right output signals of two channels.

According to the exemplary embodiment of the present invention, the direction renderer 120-1 filters the input audio signal using an interaural transfer function (ITF), a modified ITF (MITF), or a combination thereof instead of the HRTF, in order to prevent the characteristic of an anechoic room from being reflected into the binaural signal. Hereinafter, a binaural rendering method using transfer functions according to various exemplary embodiments of the present invention will be described.

<Binaural Rendering Using ITF>

First, the direction renderer 120-1 filters the input audio signal using the ITF. The ITF may be defined as a transfer function which divides the contralateral HRTF by the ipsilateral HRTF as represented in the following Equation 1.

$$I_I(k)=1$$

$$I_C(k)=H_C(k)/H_I(k) \qquad \text{[Equation 1]}$$

Herein, k is a frequency index, H_I(k) is an ipsilateral HRTF of a frequency k, H_C(k) is a contralateral HRTF of the frequency k, I_I(k) is an ipsilateral ITF of the frequency k, and I_C(k) is a contralateral ITF of the frequency k.

That is, according to the exemplary embodiment of the present invention, at each frequency k, a value of I_I(k) is defined as 1 (that is, 0 dB) and I_C(k) is defined as a value obtained by dividing H_C(k) by H_I(k) in the frequency k. The ipsilateral filtering unit 122*a* of the direction renderer 120-1 filters the input audio signal with the ipsilateral ITF to generate an ipsilateral output signal and the contralateral filtering unit 122*b* filters the input audio signal with the contralateral ITF to generate a contralateral output signal. In this case, as represented in Equation 1, when the ipsilateral ITF is 1, that is, the ipsilateral ITF is a unit delta function in the time domain or all gain values are 1 in the frequency domain, the ipsilateral filtering unit 122*a* may bypass the filtering of the input audio signal. As described above, the ipsilateral filtering is bypassed and the contralateral filtering is performed on the input audio signal with the contralateral ITF, thereby the binaural rendering using the ITF is performed. The direction renderer 120-1 omits an operation of the ipsilateral filtering unit 122*a* to obtain a gain of a computational complexity.

ITF is a function indicating a difference between the ipsilateral prototype transfer function and the contralateral prototype transfer function and the listener may recognize a sense of locality using the difference of the transfer functions as a clue. During the processing step of the ITF, room characteristics of the HRTF are cancelled and thus a phenomenon in which an awkward sound (mainly a sound in which a bass sound is missing) is generated in the rendering using the HRTF may be compensated. Meanwhile, according to another exemplary embodiment of the present invention, I_C(k) is defined as 1 and I_I(k) may be defined as a value obtained by dividing H_I(k) by H_C(k) in the frequency k. In this case, the direction renderer 120-1 bypasses the contralateral filtering and performs the ipsilateral filtering on the input audio signal with the ipsilateral ITF.

<Binaural Rendering Using MITF>

When the binaural rendering is performed using ITF, the rendering is performed only on one channel between L/R pair, so that a gain in the computational complexity is large. However, when the ITF is used, the sound image localization may deteriorate due to loss of unique characteristics of the HRTF such as a spectral peak, a notch, and the like. Further, when there is a notch in the HRTF (an ipsilateral HRTF in the above exemplary embodiment) which is a denominator of the ITF, a spectral peak having a narrow bandwidth is generated in the ITF, which causes a tone noise. Therefore, according to another exemplary embodiment of the present invention, the ipsilateral transfer function and the contralateral transfer function for the binaural filtering may be generated by modifying the ITF for the input audio signal. The direction renderer 120-1 filters the input audio signal using the modified ITF (that is, MITF).

Figure 4:
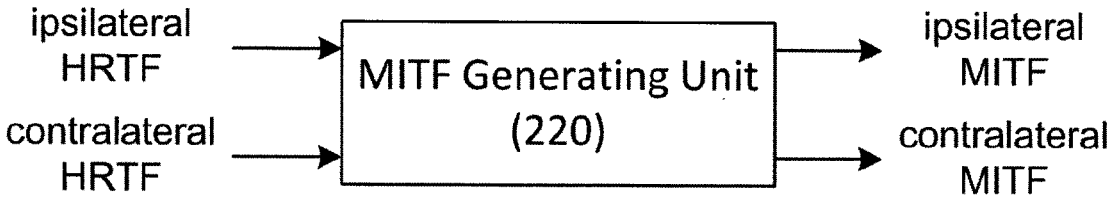
FIG. 4 is a diagram illustrating a modified ITF (MITF) generating method according to an exemplary embodiment of the present invention.

FIG. 4 is a diagram illustrating a modified ITF (MITF) generating method according to an exemplary embodiment of the present invention. An MITF generating unit 220 is a component of the binaural parameter controller 200 of FIG. 1 and receives the ipsilateral HRTF and the contralateral HRTF to generate an ipsilateral MITF and a contralateral MITF. The ipsilateral MITF and the contralateral MITF generated in the MITF generating unit 220 are transferred to the ipsilateral filtering unit 122*a* and the contralateral filtering unit 122*b* of FIG. 3 to be used for ipsilateral filtering and contralateral filtering.

Hereinafter, an MITF generating method according to various exemplary embodiments of the present invention will be described with reference to Equations. In an exemplary embodiment of the present invention, a first lateral refers to any one of ipsilateral and contralateral and a second lateral refers to the other one. For the purpose of convenience, even though the present invention is described on the assumption that the first lateral refers to the ipsilateral and the second lateral refers to the contralateral, the present invention may be implemented in the same manner when the first lateral refers to the contralateral and the second lateral refers to the ipsilateral. That is, in Equations and exemplary embodiments of the present invention, ipsilateral and contralateral may be exchanged with each other to be used. For example, an operation which divides the ipsilateral HRTF by the contralateral HRTF to obtain the ipsilateral MITF may be replaced with an operation which divides the contralateral HRTF by the ipsilateral HRTF to obtain the contralateral MITF In the following exemplary embodiments, the MITF is generated using a prototype transfer function HRTF. However, according to an exemplary embodiment of the present invention, a prototype transfer function other than the HRTF, that is, another binaural parameter may be used to generate the MITF.

(First Method of MITF—Conditional Ipsilateral Filtering)

According to a first exemplary embodiment of the present invention, when a value of the contralateral HRTF is larger than the ipsilateral HRTF at a specific frequency index k, the MITF may be generated based on a value obtained by dividing the ipsilateral HRTF by the contralateral HRTF. That is, when a magnitude of the ipsilateral HRTF and a magnitude of the contralateral HRTF are reversed due to a notch component of the ipsilateral HRTF, on the contrary to the operation of the ITF, the ipsilateral HRTF is divided by the contralateral HRTF to prevent the spectral peak from being generated. More specifically, when the ipsilateral HRTF is H_I(k), the contralateral HRTF is H_C(k), the ipsilateral MITF is M_I(k), and the contralateral MITF is M_C(k) with respect to the frequency index k, the ipsilateral MITF and the contralateral MITF may be generated as represented in the following Equation 2.

$$\begin{aligned}&\text{if } (H_I(k)<H_C(k))\\&M_I(k)=H_I(k)/H_C(k)\\&M_C(k)=1\\&\text{else}\\&M_I(k)=1\\&M_C(k)=H_C(k)/H_I(k)\end{aligned} \quad \text{[Equation 2]}$$

That is, according to the first exemplary embodiment, when the value of H_I(k) is smaller than the value of H_C(k) at a specific frequency index k (that is, in a notch region), M_I(k) is determined to be a value obtained by dividing H_I(k) by H_C(k) and the value of M_C(k) is determined to be 1. In contrast, when the value of H_I(k) is not smaller than the value of H_C(k), the value of M_I(k) is determined to be 1 and the value of M_C(k) is determined to a value obtained by dividing H_C(k) by H_I(k).

(Second Method of MITF—Cutting)

According to a second exemplary embodiment of the present invention, when the HRTF which is a denominator of the ITF at a specific frequency index k, that is, the ipsilateral HRTF has a notch component, values of the ipsilateral MITF and the contralateral MITF at the frequency index k may be set to be 1 (that is, 0 dB). A second exemplary embodiment of the MITF generating method is mathematically expressed as represented in following Equation 3.

$$\begin{aligned}&\text{if } (H_I(k)<H_C(k))\\&M_I(k)=1\\&M_C(k)=1\\&\text{else}\\&M_I(k)=1\\&M_C(k)=H_C(k)/H_I(k)\end{aligned} \quad \text{[Equation 3]}$$

That is, according to the second exemplary embodiment, when the value of H_I(k) is smaller than the value of H_C(k) at a specific frequency index k (that is, in a notch region), values of M_I(k) and M_C(k) are determined to be 1. In contrast, when the value of H_I(k) is not smaller than the value of H_C(k), the ipsilateral MITF and the contralateral MITF may be set to be same as the ipsilateral ITF and the contralateral ITF, respectively. That is, the value of MITF M_I(k) is determined to be 1 and the value of M_C(k) is determined to be a value obtained by dividing H_C(k) by H_I(k).

(Third Method of MITF—Scaling)

According to a third exemplary embodiment of the present invention, a weight is reflected to the HRTF having the notch component to reduce the depth of the notch. In order to reflect a weight which is larger than 1 to the notch component of HRTF which is a denominator of ITF, that is, the notch component of the ipsilateral HRTF, a weight function w(k) may be applied as represented in Equation 4.

$$\text{if } (H_I(k)<H_C(k))$$

$$M_I(k)=1$$

$$M_C(k)=H_C(k)/(w(k)*H_I(k))$$

$$\text{else}$$

$$M_I(k)=1$$

$$M_C(k)=H_C(k)/H_I(k) \qquad \text{[Equation 4]}$$

Herein, the symbol * refers to multiplication. That is, according to the third exemplary embodiment, when the value of H_I(k) is smaller than the value of H_C(k) at a specific frequency index k (that is, in a notch region), M_I(k) is determined to be 1 and the value of M_C(k) is determined to be a value obtained by dividing H_C(k) by multiplication of w(k) and H_I(k). In contrast, when the value of H_I(k) is not smaller than the value of H_C(k), the value of M_I(k) is determined to be 1 and the value of M_C(k) is determined to a value obtained by dividing H_C(k) by H_I(k). That is, the weight function w(k) is applied when the value of H_I(k) is smaller than the value of H_C(k). According to an exemplary embodiment, the weight function w(k) is set to have the larger value as the depth of the notch of the ipsilateral HRTF becomes larger, that is, as the value of the ipsilateral HRTF becomes smaller. According to another exemplary embodiment, the weight function w(k) may be set to have the large value as the difference between the value of the ipsilateral HRTF and the value of the contralateral HRTF becomes larger.

Conditions of the first, the second and the third exemplary embodiments may extend to a case in which the value of H_I(k) is smaller than a predetermined ratio $\alpha$ of the value of H_C(k) at a specific frequency index k. That is, when the value of H_I(k) is smaller than a value of $\alpha$*H_C(k), the ipsilateral MITF and the contralateral MITF may be generated based on equations in a conditional statement in each exemplary embodiment. In contrast, when the value of H_I(k) is not smaller than the value of $\alpha$*H_C(k), the ipsilateral MITF and the contralateral MITF may be set to be same as the ipsilateral ITF and the contralateral ITF. Further, the condition parts of the first, the second and the third exemplary embodiments may be used to be limited to the specific frequency band and different values may be applied to the predetermined ratio $\alpha$ depending on the frequency band.

(Fourth-One Method of MITF—Notch Separating)

Figure 5:
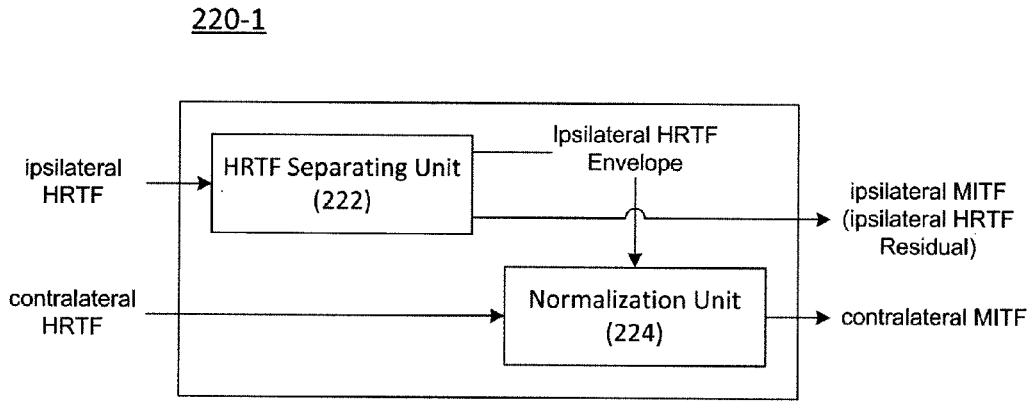
FIG. 5 is a diagram illustrating a MITF generating method according to another exemplary embodiment of the present invention.

According to a fourth exemplary embodiment of the present invention, the notch component of HRTF is separated and the MITF may be generated based on the separated notch component. FIG. 5 is a diagram illustrating a MITF generating method according to the fourth exemplary embodiment of the present invention. The MITF generating unit 220-1 may further include an HRTF separating unit 222 and a normalization unit 224. The HRTF separating unit 222 separates the prototype transfer function, that is, HRTF into an HRTF envelope component and an HRTF notch component.

According to the exemplary embodiment of the present invention, the HRTF separating unit 222 separates HRTF which is a denominator of ITF, that is, the ipsilateral HRTF into an HRTF envelope component and an HRTF notch component and the MITF may be generated based on the separated ipsilateral HRTF envelope component and ipsilateral HRTF notch component. The fourth exemplary embodiment of the MITF generating method is mathematically expressed as represented in the following Equation 5.

$$M_I(k)=H_I_\text{notch}(k)$$

$$M_C(k)=H_C_\text{notch}(k)*H_C_\text{env}(k)/H_I_\text{env}(k) \qquad \text{[Equation 5]}$$

Herein, k indicates a frequency index, H_I_notch(k) indicates an ipsilateral HRTF notch component, H_I_env(k) indicates an ipsilateral HRTF envelope component, H_C_notch(k) indicates a contralateral HRTF notch component, and H_C_env(k) indicates a contralateral HRTF envelope component. The symbol * refers to multiplication and H_C_notch(k)*H_C_env(k) may be replaced by non-separated contralateral HRTF H_C(k).

That is, according to the fourth exemplary embodiment, M_I(k) is determined to be a value of a notch component H_I_notch(k) which is extracted from the ipsilateral HRTF and M_C(k) is determined to be a value obtained by dividing the contralateral HRTF H_C(k) by an envelope component H_I_env(k) extracted from the ipsilateral HRTF. Referring to FIG. 5, the HRTF separating unit 222 extracts the ipsilateral HRTF envelope component from the ipsilateral HRTF and a remaining component of the ipsilateral HRTF, that is, the notch component is output as the ipsilateral MITF. Further, the normalization unit 224 receives the ipsilateral HRTF envelope component and the contralateral HRTF and generates and outputs the contralateral MITF in accordance with the exemplary embodiment of Equation 5.

Spectral notch is generally generated when a reflection is generated in a specific position of an external ear so that the spectral notch of HRTF may significantly contribute to recognizing an elevation perception. Generally, the notch is characterized by rapid change in a spectral domain. In contrast, the binaural cue represented by the ITF is characterized by slow change in the spectrum domain. Therefore, according to an exemplary embodiment, the HRTF separating unit 222 separates the notch component of the HRTF using homomorphic signal processing using cepstrum or wave interpolation.

For example, the HRTF separating unit 222 performs windowing the cepstrum of the ipsilateral HRTF to obtain an ipsilateral HRTF envelope component. The MITF generating unit 200 divides each of the ipsilateral HRTF and the contralateral HRTF by the ipsilateral HRTF envelope component, thereby generating an ipsilateral MITF from which a spectral coloration is removed. Meanwhile, according to an additional exemplary embodiment of the present invention, the HRTF separating unit 222 may separate the notch component of the HRTF using all-pole modeling, pole-zero modeling, or a group delay function.

Meanwhile, according to an additional exemplary embodiment of the present invention, H_I_notch(k) is approximated to FIR filter coefficients or IIR filter coefficients and the approximated filter coefficients may be used as an ipsilateral transfer function of the binaural rendering. That is, the ipsilateral filtering unit of the direction renderer filters the input audio signal with the approximated filter coefficients to generate the ipsilateral output signal.

(Fourth-Two Method of MITF—Notch Separating/Using HRTF Having Different Altitude)

According to an additional exemplary embodiment of the present invention, in order to generate MITF for a specific angle, an HRTF envelope component having a direction which is different from that of the input audio signal may be used. For example, the MITF generating unit 200 normalizes another HRTF pair (an ipsilateral HRTF and a contralateral HRTF) with the HRTF envelope component on a horizontal plane (that is, an altitude is zero) to implement the transfer functions located on the horizontal plane to be an MITF having a flat spectrum. According to an exemplary embodiment of the present invention, the MITF may be generated by a method of the following Equation 6.

$$M_I(k,\theta,\phi)=H_I_\text{notch}(k,\theta,\phi)$$

$$M_C(k,\theta,\phi))=H_C(k,\theta,\phi)/H_I(k,0,\phi) \quad \text{[Equation 6]}$$

Herein, k is a frequency index, θ is an altitude, ϕ is an azimuth.

That is, the ipsilateral MITF M_I(k, θ, ϕ) of the altitude θ and the azimuth ϕ is determined by a notch component H_I_notch(k, θ, ϕ) extracted from the ipsilateral HRTF of the altitude θ and the azimuth ϕ, and the contralateral MITF M_C(k, θ, ϕ) is determined by a value obtained by dividing the contralateral HRTF H_C(k, θ, ϕ) of the altitude θ and the azimuth ϕ by the envelope component H_I_env(k, 0, ϕ) extracted from the ipsilateral HRTF of the altitude 0 and the azimuth ϕ. According to another exemplary embodiment of the present invention, the MITF may be generated by a method of the following Equation 7.

$$M_I(k,\theta,\phi)=H_I_(k,\theta,\phi)/H_I_\text{env}(k,0,\phi)$$

$$M_C(k,\theta,\phi)=H_C(k,\theta,\phi)/H_I_\text{env}(k,0,\phi) \quad \text{[Equation 7]}$$

That is, the ipsilateral MITF M_I(k, θ, ϕ) of the altitude θ and the azimuth ϕ is determined by a value obtained by dividing the ipsilateral HRTF H_I(k, θ, ϕ) of the altitude θ and the azimuth ϕ by the H_I_env(k, 0, ϕ) and the contralateral MITF M_C(k, θ, ϕ) is determined by a value obtained by dividing the contralateral HRTF H_C(k, θ, ϕ) of the altitude θ and the azimuth ϕ by the H_I_env(k, 0, ϕ). In Equations 6 and 7, it is exemplified that an HRTF envelope component having the same azimuth and different altitude (that is, the altitude 0) is used to generate the MITF. However, the present invention is not limited thereto and the MITF may be generated using an HRTF envelope component having a different azimuth and/or a different altitude.

(Fifth Method of MITF—Notch Separating 2)

According to a fifth exemplary embodiment of the present invention, the MITF may be generated using wave interpolation which is expressed by spatial/frequency axes. For example, the HRTF is separated into a slowly evolving waveform (SEW) and a rapidly evolving waveform (REW) which are three-dimensionally expressed by an altitude/frequency axis or an azimuth/frequency axis. In this case, the binaural cue (for example, ITF, interaural parameter) for binaural rendering is extracted from the SEW and the notch component is extracted from the REW.

According to an exemplary embodiment of the present invention, the direction renderer performs the binaural rendering using a binaural cue extracted from the SEW and directly applies the notch component extracted from the REW to each channel (an ipsilateral channel/a contralateral channel) to suppress a tone noise. In order to separate the SEW and the REW in the wave interpolation of the spatial/frequency domain, methods of a homomorphic signal processing, a low/high pass filtering, and the like may be used.

(Sixth Method of MITF—Notch Separating 3)

According to a sixth exemplary embodiment of the present invention, in a notch region of the prototype transfer function, the prototype transfer function is used for the binaural filtering and in a region other than the notch region, the MITF according to the above-described exemplary embodiments may be used for the binaural filtering. This will be mathematically expressed by the following Equation 8.

If $k$ lies notch region $$M'_I(k)=H_I(k)$$

$$M'_C(k)=H_C(k)$$

else $$M'_I(k)=M_I(k)$$

$$M'_C(k)=M_C(k) \quad \text{[Equation 8]}$$

Herein, M'_I(k) and M'_C(k) are the ipsilateral MITF and the contralateral MITF according to the sixth exemplary embodiment and M_I(k) and M_C(k) are the ipsilateral MITF and the contralateral MITF according to any one of the above-described exemplary embodiments. H_I(k) and H_C(k) indicate the ipsilateral HRTF and the contralateral HRTF which are prototype transfer functions. That is, in the case of the frequency band in which the notch component of the ipsilateral HRTF is included, the ipsilateral HRTF and the contralateral HRTF are used as the ipsilateral transfer function and the contralateral transfer function of the binaural rendering, respectively. Further, in the case of the frequency band in which the notch component of the ipsilateral HRTF is not included, the ipsilateral MITF and the contralateral MITF are used as the ipsilateral transfer function and the contralateral transfer function of the binaural rendering, respectively. In order to separate the notch region, as described above, the all-pole modeling, the pole-zero modeling, the group delay function, and the like may be used. According to an additional exemplary embodiment of the present invention, smoothing techniques such as low pass filtering may be used in order to prevent degradation of a sound quality due to sudden spectrum change at a boundary of the notch region and the non-notch region.

(Seventh Method of MITF—Notch Separating with Low Complexity)

Figure 6:
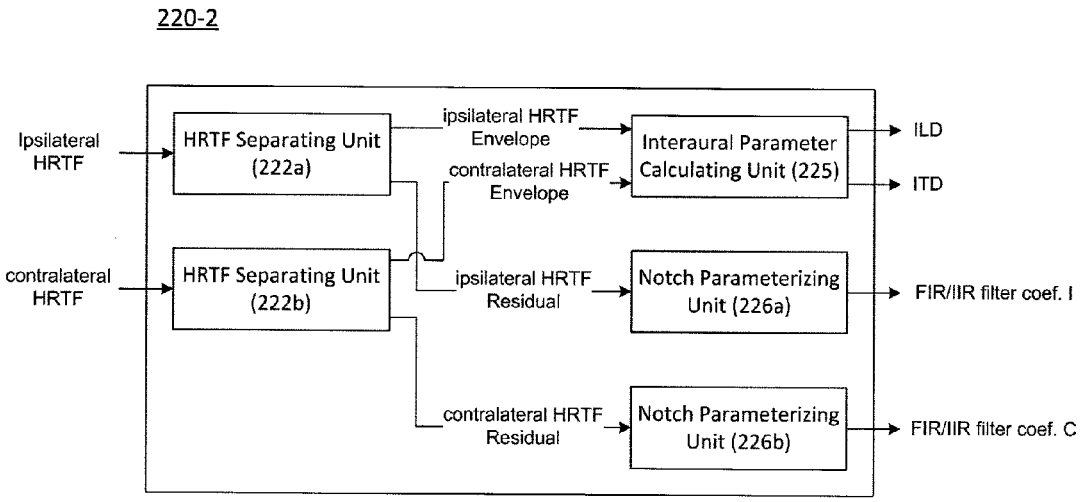
FIG. 6 is a diagram illustrating a binaural parameter generating method according to another exemplary embodiment of the present invention.
Figure 7:
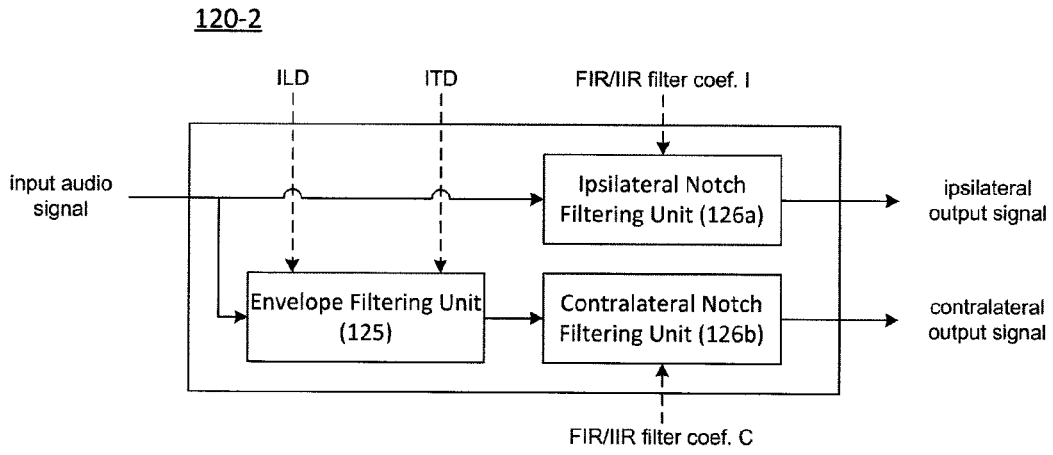
FIG. 7 is a block diagram of a direction renderer according to another exemplary embodiment of the present invention.

According to a seventh exemplary embodiment of the present invention, a remaining component of the HRTF separation, that is, the notch component may be processed by a simpler operation. According to an exemplary embodiment, the HRTF remaining component is approximated to FIR filter coefficients or IIR filter coefficients, and the approximated filter coefficients may be used as the ipsilateral and/or contralateral transfer function of the binaural rendering. FIG. 6 is a diagram illustrating a binaural parameter generating method according to the seventh exemplary embodiment of the present invention and FIG. 7 is a block diagram of a direction renderer according to the seventh exemplary embodiment of the present invention.

First, FIG. 6 illustrates a binaural parameter generating unit 220-2 according to an exemplary embodiment of the present invention. Referring to FIG. 6, the binaural parameter generating unit 220-2 includes HRTF separating units 222*a* and 222*b*, an interaural parameter calculating unit 225, and notch parameterizing units 226*a* and 226*b*. According to an exemplary embodiment, the binaural parameter generating unit 220-2 may be used as a configuration replacing the MITF generating unit of FIGS. 4 and 5.

First, the HRTF separating units 222*a* and 222*b* separate the input HRTF into an HRTF envelope component and an HRTF remaining component. A first HRTF separating unit 222*a* receives the ipsilateral HRTF and separates the ipsilateral HRTF into an ipsilateral HRTF envelope component and an ipsilateral HRTF remaining component. A second HRTF separating unit 222*b* receives the contralateral HRTF and separates the contralateral HRTF into a contralateral HRTF envelope component and a contralateral HRTF remaining component. The interaural parameter calculating unit 225 receives the ipsilateral HRTF envelope component and the contralateral HRTF envelope component and generates an interaural parameter using the components. The interaural parameter includes an interaural level difference (ILD) and an interaural time difference (ITD). In this case, the ILD corresponds to a size of an interaural transfer function and the ITD corresponds to a phase (or a time difference in the time domain) of the interaural transfer function.

Meanwhile, the notch parameterizing units 226*a* and 226*b* receive the HRTF remaining component and approximate the HRTF remaining component to impulse response (IR) filter coefficients. The HRTF remaining component includes the HRTF notch component and the IR filter includes an FIR filter and an IIR filter. The first notch parameterizing unit 226*a* receives the ipsilateral HRTF remaining component and generates ipsilateral IR filter coefficients using the same. The second notch parameterizing unit 226*b* receives the contralateral HRTF remaining component and generates contralateral IR filter coefficients using the same.

As described above, the binaural parameter generated by the binaural parameter generating unit 220-2 is transferred to the direction renderer. The binaural parameter includes an interaural parameter and the ipsilateral/contralateral IR filter coefficients. In this case, the interaural parameter includes at least ILD and ITD.

FIG. 7 is a block diagram of a direction renderer 120-2 according to an exemplary embodiment of the present invention. Referring to FIG. 7, the direction renderer 120-2 includes an envelope filtering unit 125 and ipsilateral/contralateral notch filtering units 126*a* and 126*b*. According to an exemplary embodiment, the ipsilateral notch filtering unit 126*a* may be used as a component replacing the ipsilateral filtering unit 122*a* of FIG. 2, and the envelope filtering unit 125 and the contralateral notch filtering unit 126*b* may be used as components replacing the contralateral filtering unit 122*b* of FIG. 2.

First, the envelope filtering unit 125 receives the interaural parameter and filters the input audio signal based on the received interaural parameter to reflect a difference between ipsilateral/contralateral envelopes. According to the exemplary embodiment of FIG. 7, the envelope filtering unit 125 may perform filtering for the contralateral signal, but the present invention is not limited thereto. That is, according to another exemplary embodiment, the envelope filtering unit 125 may perform filtering for the ipsilateral signal. When the envelope filtering unit 125 performs the filtering for the contralateral signal, the interaural parameter may indicate relative information of the contralateral envelope with respect to the ipsilateral envelope and when the envelope filtering unit 125 performs the filtering for the ipsilateral signal, the interaural parameter may indicate relative information of the ipsilateral envelope with respect to the contralateral envelope.

Next, the notch filtering units 126*a* and 126*b* perform filtering for the ipsilateral/contralateral signals to reflect the notches of the ipsilateral/contralateral transfer functions, respectively. The first notch filtering unit 126*a* filters the input audio signal with the ipsilateral IR filter coefficients to generate an ipsilateral output signal. The second notch filtering unit 126*b* filters the input audio signal on which the envelope filtering is performed with the contralateral IR filter coefficients to generate a contralateral output signal. Even though the envelope filtering is performed prior to the notch filtering in the exemplary embodiment of FIG. 7, the present invention is not limited thereto. According to another exemplary embodiment of the present invention, the envelope filtering may be performed on the ipsilateral or contralateral signal after performing the ipsilateral/contralateral notch filtering on the input audio signal.

As described above, according to the exemplary embodiment of FIG. 7, the direction renderer 120-2 performs the ipsilateral filtering using the ipsilateral notch filtering unit 126*a*. Further, the direction renderer 120-2 performs the contralateral filtering using the envelope filtering unit 125 and the contralateral notch filtering unit 126*b*. In this case, the ipsilateral transfer function which is used for the ipsilateral filtering includes IR filter coefficients which are generated based on the notch component of the ipsilateral HRTF. Further, the contralateral transfer function used for the contralateral filtering includes IR filter coefficients which are generated based on the notch component of the contralateral HRTF, and the interaural parameter. Herein, the interaural parameter is generated based on the envelope component of the ipsilateral HRTF and the envelope component of the contralateral HRTF.

(Eighth Method of MITF—Hybrid ITF)

According to an eighth exemplary embodiment of the present invention, a hybrid ITF (HITF) in which two or more of the above mentioned ITF and MITF are combined may be used. In an exemplary embodiment of the present invention, the HITF indicates an interaural transfer function in which a transfer function used in at least one frequency band is different from a transfer function used in the other frequency band. That is, the ipsilateral and contralateral transfer functions which are generated based on different transfer functions in a first frequency band and a second frequency band may be used. According to an exemplary embodiment of the present invention, the ITF is used for the binaural rendering of the first frequency band and the MITF is used for the binaural rendering of the second frequency band.

More specifically, in the low frequency band, a level difference of both ears, a phase difference of both ears, and the like are important factors of the sound image localization and in the high frequency band, a spectral envelope, a specific notch, a peak, and the like are important clues of the sound image localization. Accordingly, in order to efficiently reflect this, the ipsilateral and contralateral transfer functions of the low frequency band are generated based on the ITF and the ipsilateral and contralateral transfer functions of the high frequency band are generated based on the MITF. This will be mathematically expressed by the following Equation 9.

if ($k<C0$)

$h_I(k)=I_I(k)$ $h_C(k)=I_C(k)$ else $h_I(k)=M_I(k)$ $h_C(k)=M_C(k)$ [Equation 9]

Herein, k is a frequency index, CO is a critical frequency index, h_I(k) and h_C(k) are ipsilateral and contralateral HITFs according to an exemplary embodiment of the present inventions, respectively. Further, I_I(k) and I_C(k) indicate the ipsilateral and contralateral ITFs and M_I(k) and M_C(k) indicate ipsilateral and contralateral MITFs according to any one of the above-described exemplary embodiments.

That is, according to an exemplary embodiment of the present invention, the ipsilateral and contralateral transfer functions in a first frequency band whose frequency index is lower than the critical frequency index are generated based on the ITF and the ipsilateral and contralateral transfer functions in a second frequency band whose frequency index is equal to or higher than the critical frequency index are generated based on the MITF. According to an exemplary embodiment, the critical frequency index CO indicates a specific frequency between 500 Hz and 2 kHz.

Meanwhile, according to another exemplary embodiment of the present invention, the ipsilateral and contralateral transfer functions of the low frequency band are generated based on the ITF, the ipsilateral and contralateral transfer functions of the high frequency band are generated based on the MITF, and ipsilateral and contralateral transfer functions in an intermediate frequency band between the low frequency band and the high frequency band are generated based on a linear combination of the ITF and the MITF. This will be mathematically expressed by the following Equation 10.

if ($k<C1$)

$h_I(k)=I_I(k)$ $h_C(k)=I_C(k)$ else if ($C1\leq k\leq C2$)

$h_I(k)=g1(k)*I_I(k)+g2(k)*M_I(k)$ $h_C(k)=g1(k)*I_C(k)+g2(k)*M_C(k)$ else $h_I(k)=M_I(k)$ $h_C(k)=M_C(k)$ [Equation 10]

Herein, C1 indicates a first critical frequency index and C2 indicates a second critical frequency index. Further, g1(k) and g2(k) indicate gains for the ITF and the MITF at the frequency index k, respectively.

That is, according to another exemplary embodiment of the present invention, the ipsilateral and contralateral transfer functions in a first frequency band whose frequency index is lower than the first critical frequency index are generated based on the ITF, and the ipsilateral and contralateral transfer functions in a second frequency band whose frequency index is higher than the second critical frequency index are generated based on the MITF. Further, the ipsilateral and contralateral transfer functions of a third frequency band whose frequency index is between the first critical frequency index and the second frequency index are generated based on a linear combination of the ITF and the MITF. However, the present invention is not limited thereto and the ipsilateral and contralateral transfer functions of the third frequency band may be generated based on at least one of a log combination, a spline combination, and a Lagrange combination of the ITF and the MITF.

According to an exemplary embodiment, the first critical frequency index C1 indicates a specific frequency between 500 Hz and 1 kHz, and the second critical frequency index C2 indicates a specific frequency between 1 kHz and 2 kHz. Further, for the sake of energy conservation, a value of sum of squares of gains g1(k) and g2(k) may satisfy g1(k)^2+g2(k)^2=1. However, the present invention is not limited thereto.

Meanwhile, the transfer function generated based on the ITF and the transfer function generated based on the MITF may have different delays. According to an exemplary embodiment of the present invention, when a delay of the ipsilateral/contralateral transfer functions of a specific frequency band is different from a delay of the ipsilateral/contralateral transfer functions of a different frequency band, delay compensation may be further performed on ipsilateral/contralateral transfer functions having a short delay with respect to the ipsilateral/contralateral transfer function having a long delay.

According to another exemplary embodiment of the present invention, the ipsilateral and contralateral HRTFs are used for the ipsilateral and contralateral transfer functions of the first frequency band and the ipsilateral and contralateral transfer functions of the second frequency band may be generated based on the MITF. Alternatively, the ipsilateral and contralateral transfer functions of the first frequency band may be generated based on information extracted from at least one of ILD, ITD, interaural phase difference (IPD), and interaural coherence (IC) for each frequency band of the ipsilateral and the contralateral HRTFs and the ipsilateral and contralateral transfer functions of the second frequency band may be generated based on the MITF.

According to another exemplary embodiment of the present invention, the ipsilateral and contralateral transfer functions of the first frequency band are generated based on the ipsilateral and contralateral HRTFs of a spherical head model and the ipsilateral and contralateral transfer functions of the second frequency band are generated based on the measured ipsilateral and contralateral HRTFs. According to an exemplary embodiment, the ipsilateral and contralateral transfer functions of a third frequency band between the first frequency band and the second frequency band may be generated based on the linear combination, overlapping, windowing, and the like of the HRTF of the spherical head model and the measured HRTF.

(Ninth Method of MITF—Hybrid ITF 2)

According to a ninth exemplary embodiment of the present invention, a hybrid ITF (HITF) in which two or more of HRTF, ITF and MITF are combined may be used. According to the exemplary embodiment of the present invention, in order to increase a sound phase localization performance, a spectral characteristic of a specific frequency band may be emphasized. When the above-described ITF or MITF is used, coloration of the sound source is reduced, but a trade-off phenomenon that the performance of sound image localization is also lowered is caused. Therefore, in order to improve the performance of the sound image localization, additional refinement for the ipsilateral/contralateral transfer functions is required.

According to an exemplary embodiment of the present invention, the ipsilateral and contralateral transfer functions of a low frequency band which dominantly affect the coloration of the sound source are generated based on the MITF (or ITF), and the ipsilateral and contralateral transfer functions of a high frequency band which dominantly affect the sound image localization are generated based on the HRTF. This will be mathematically expressed by the following Equation 11.

if ($k<C0$)

$h_I(k)=M_I(k)$ $h_C(k)=M_C(k)$ else $h_I(k)=H_I(k)$ $h_C(k)=H_C(k)$ [Equation 11]

Herein, k is a frequency index, C0 is a critical frequency index, h_I(k) and h_C(k) are ipsilateral and contralateral HITFs according to an exemplary embodiment of the present inventions, respectively. Further, HI_I(k) and H_C(k) indicate the ipsilateral and contralateral HRTFs and M_I(k) and M_C(k) indicate ipsilateral and contralateral MITFs according to any one of the above-described exemplary embodiments.

That is, according to an exemplary embodiment of the present invention, the ipsilateral and contralateral transfer functions in a first frequency band whose frequency index is lower than the critical frequency index are generated based on the MITF, and the ipsilateral and contralateral transfer functions in a second frequency band whose frequency index is equal to or higher than the critical frequency index are generated based on the HRTF. According to an exemplary embodiment, the critical frequency index CO indicates a specific frequency between 2 kHz and 4 kHz, but the present invention is not limited thereto.

According to another exemplary embodiment of the present invention, the ipsilateral and contralateral transfer functions are generated based on the ITF and a separate gain may be applied to the ipsilateral and contralateral transfer functions of the high frequency band. This will be mathematically expressed by the following Equation 12.

if ($k<C0$)

$h_I(k)=1$ $h_C(k)=H_C(k)/H_I(k)$ else $h_I(k)=G$ $h_C(k)=G*H_C(k)/H_I(k)$ [Equation 12]

Herein, G indicates a gain. That is, according to another exemplary embodiment of the present invention, the ipsilateral and contralateral transfer functions in a first frequency band whose frequency index is lower than the critical frequency index are generated based on the ITF, and the ipsilateral and contralateral transfer functions in a second frequency band whose frequency index is equal to or higher than the critical frequency index are generated based on a value obtained by multiplying the ITF and a predetermined gain G.

According to another exemplary embodiment of the present invention, the ipsilateral and contralateral transfer functions are generated based on the MITF according to any one of the above-described exemplary embodiments and a separate gain may be applied to the ipsilateral and contralateral transfer functions of the high frequency band. This will be mathematically expressed by the following Equation 13.

if ($k<C0$)

$h_I(k)=M_I(k)$ $h_C(k)=M_C(k)$ else $h_I(k)=G*M_I(k)$ $h_C(k)=G*M_C(k)$ [Equation 13]

That is, according to another exemplary embodiment of the present invention, the ipsilateral and contralateral transfer functions in a first frequency band whose frequency index is lower than the critical frequency index are generated based on the MITF and the ipsilateral and contralateral transfer functions in a second frequency band whose frequency index is equal to or higher than the critical frequency index are generated based on a value obtained by multiplying the MITF and the predetermined gain G.

The gain G which is applied to the HITF may be generated according to various exemplary embodiments. According to an exemplary embodiment, in the second frequency band, an average value of HRTF magnitudes having the maximum altitude and an average value of HRTF magnitudes having the minimum altitude are calculated, respectively, and the gain G may be obtained based on interpolation using a difference between two average values. In this case, different gains are applied for each frequency bin of the second frequency band so that resolution of the gain may be improved.

Meanwhile, in order to prevent distortion caused by discontinuity between the first frequency band and the second frequency band, a gain which is smoothened at a frequency axis may be additionally used. According to an exemplary embodiment, a third frequency band may be set between the first frequency band in which the gain is not applied and the second frequency band in which the gain is applied. A smoothened gain is applied to ipsilateral and contralateral transfer functions of the third frequency band. The smoothened gain may be generated based on at least one of linear interpolation, log interpolation, spline interpolation, and Lagrange interpolation. Since the smoothened gain has different values for each bin, the smoothened gain may be expressed as G(k).

Figure 8:
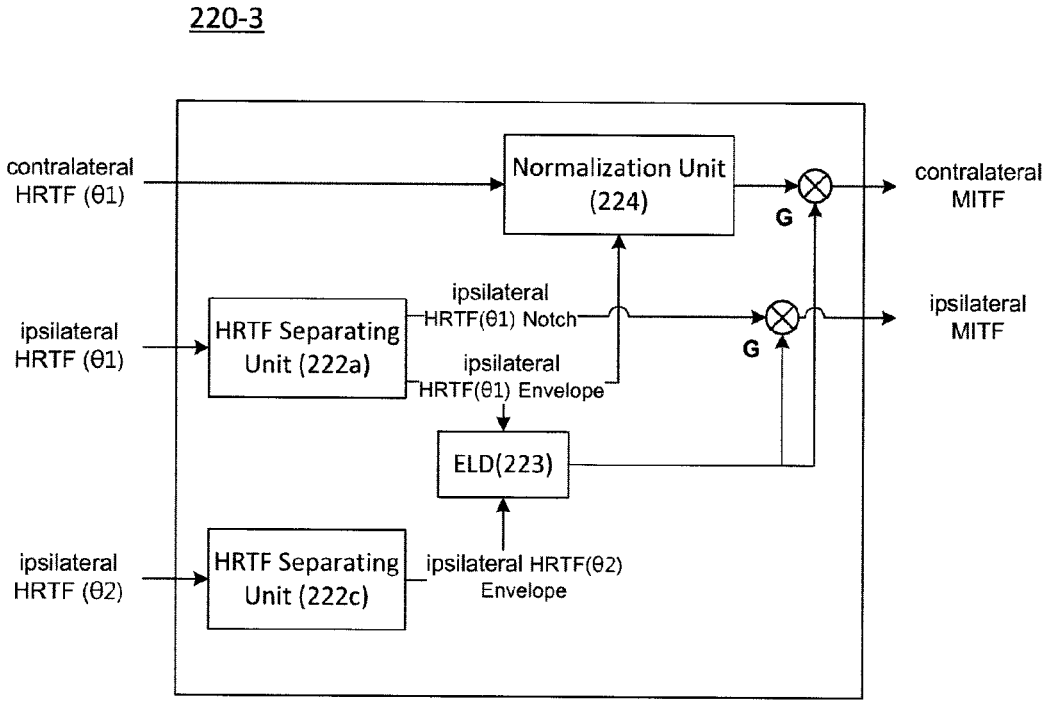
FIG. 8 is a diagram illustrating a MITF generating method according to another exemplary embodiment of the present invention.

According to another exemplary embodiment of the present invention, the gain G may be obtained based on an envelope component extracted from HRTF having different altitude. FIG. 8 is a diagram illustrating an MITF generating method to which a gain according to another exemplary embodiment of the present invention is applied. Referring to FIG. 8, an MITF generating unit 220-3 includes HRTF separating units 222*a* and 222*c*, an elevation level difference (ELD) calculating unit 223, and a normalization unit 224.

FIG. 8 illustrates an exemplary embodiment in which the MITF generating unit 223-3 generates ipsilateral and contralateral MITFs having a frequency k, an altitude θ1, and an azimuth ϕ. First, the first HRTF separating unit 222*a* separates the ipsilateral HRTF having an altitude θ1 and an azimuth ϕ into an ipsilateral HRTF envelope component and an ipsilateral HRTF notch component. Meanwhile, the second HRTF separating unit 222*c* separates an ipsilateral HRTF having a different altitude θ2 into an ipsilateral HRTF envelope component and an ipsilateral HRTF notch component. θ2 is an altitude which is different from θ1 and according to an exemplary embodiment, θ2 may be set to be 0 degree (that is, an angle on the horizontal plane).

The ELD calculating unit 223 receives an ipsilateral HRTF envelope component of the altitude θ1 and an ipsilateral HRTF envelope component of the altitude θ2 and generates the gain G based thereon. According to an exemplary embodiment, the ELD calculating unit 223 sets the gain value to be close to 1 as a frequency response is not significantly changed in accordance with the change of the altitude and sets the gain value to be amplified or attenuated as the frequency response is significantly changed.

The MITF generating unit 222-3 generates the MITF using a gain generated in the ELD calculating unit 223. Equation 14 represents an exemplary embodiment in which the MITF is generated using the generated gain.

$$\text{if } (k<C0)$$

$$M_I(k,\theta 1,\phi)=H_I_\text{notch}(k,\theta 1,\phi)$$

$$M_C(k,\theta 1,\phi)=H_C(k,\theta 1,\phi)/H_I_\text{env}(k,\theta 1,\phi)$$

$$\text{else}$$

$$M_I(k,\theta 1,\phi)=G*H_I_\text{notch}(k,\theta 1,\phi)$$

$$M_C(k,\theta 1,\phi)=G*H_C(k,\theta 1,\phi)/H_I_\text{env}(k,\theta 1,\phi) \quad \text{[Equation 14]}$$

Ipsilateral and contralateral transfer functions in a first frequency band whose frequency index is lower than a critical frequency index are generated based on the MITF according to an exemplary embodiment of Equation 5. That is, an ipsilateral MITF M_I(k, θ1, ϕ) of the altitude θ1 and the azimuth ϕ is determined by a notch component H_I_notch(k, θ1, ϕ) extracted from the ipsilateral HRTF and a contralateral MITF M_C(k, θ1, ϕ) is determined by a value obtained by dividing the contralateral HRTF H_C(k, θ1, ϕ) by an envelope component H_I_env(k, θ1, ϕ) extracted from the ipsilateral HRTF.

However, ipsilateral and contralateral transfer functions in a second frequency band whose frequency index is equal to or larger than the critical frequency index are generated based on a value obtained by multiplying the MITF according to the exemplary embodiment of Equation 5 and the gain G. That is, M_I(k, θ1, ϕ) is determined by a value obtained by multiplying a notch component H_I_notch(k, θ1, ϕ) extracted from the ipsilateral HRTF and the gain G and M_C(k, θ1, ϕ) is determined by a value obtained by dividing a value obtained by mortifying the contralateral HRTF H_C(k, θ1, ϕ) and the gain G by an envelope component H_I_env(k, θ1, ϕ) extracted from the ipsilateral HRTF.

Therefore, referring to FIG. 8, the ipsilateral HRTF notch component separated by the first HRTF separating unit 222*a* and the gain G are multiplied to be output as an ipsilateral MITE Further, the normalization unit 224 calculates the contralateral HRTF value compared to the ipsilateral HRTF envelope component as represented in Equation 14 and the calculated value and the gain G are multiplied to be output as a contralateral MITE In this case, the gain G is a value generated based on the ipsilateral HRTF envelope component having the altitude θ1 and an ipsilateral HRTF envelope component having a different altitude θ2. Equation 15 represents an exemplary embodiment in which the gain G is generated.

$$G=H_I_\text{env}(k,\theta 2,\phi)/H_I_\text{env}(k,\theta 1,\phi) \quad \text{[Equation 15]}$$

That is, the gain G may be determined by a value obtained by dividing the envelope component H_I_env(k, θ1, ϕ) extracted from the ipsilateral HRTF of the altitude θ1 and the azimuth ϕ by an envelope component H_I_env(k, θ2, ϕ) extracted from the ipsilateral HRTF of the altitude θ2 and the azimuth ϕ.

Meanwhile, in the above exemplary embodiment, the gain G is generated using envelope components of the ipsilateral HRTFs having different altitudes, but the present invention is not limited thereto. That is, the gain G may be generated based on envelope components of ipsilateral HRTFs having different azimuths, or envelope components of ipsilateral HRTFs having different altitudes and different azimuths. Further, the gain G may be applied not only to the HITF, but also to at least one of the ITF, MITF, and HRTF. Further, the gain G may be applied not only to a specific frequency band such as a high frequency band, but also to all frequency bands.

The ipsilateral MITF (or ipsilateral HITF) according to the various exemplary embodiments is transferred to the direction renderer as the ipsilateral transfer function and the contralateral MITF (or the contralateral HITF) is transferred to the direction renderer as the contralateral transfer function. The ipsilateral filtering unit of the direction renderer filters the input audio signal with the ipsilateral MITF (or the ipsilateral HITF) according to the above-described exemplary embodiment to generate an ipsilateral output signal and the contralateral filtering unit filters the input audio signal with the contralateral MITF (or the contralateral HITF) according to the above-described exemplary embodiment to generate a contralateral output signal.

In the above exemplary embodiment, when the value of the ipsilateral MITF or the contralateral MITF is 1, the ipsilateral filtering unit or the contralateral filtering unit may bypass the filtering operation. In this case, whether to bypass the filtering may be determined at a rendering time. However, according to another exemplary embodiment, when the prototype transfer function HRTF is determined in advance, the ipsilateral/contralateral filtering unit obtains additional information on a bypass point (for example, a frequency index) in advance and determines whether to bypass the filtering at each point based on the additional information.

Meanwhile, in the above-described exemplary embodiment and drawings, it is described that the ipsilateral filtering unit and the contralateral filtering unit receive the same input audio signal to receive the filtering, but the present invention is not limited thereto. According to another exemplary embodiment of the present invention, two channel signals on which the preprocessing is performed are received as an input of the direction renderer. For example, an ipsilateral signal d^I and a contralateral signal d^C on which the distance rendering is performed as the preprocessing step are received as an input of the direction renderer. In this case, the ipsilateral filtering unit of the direction renderer filters the received ipsilateral signal d^I with the ipsilateral transfer function to generate the ipsilateral output signal B^I. Further, the contralateral filtering unit of the direction renderer filters the received contralateral signal d^C with the contralateral transfer function to generate the contralateral output signal B^C.

<Sound Spectral Highligting>

Figure 9:
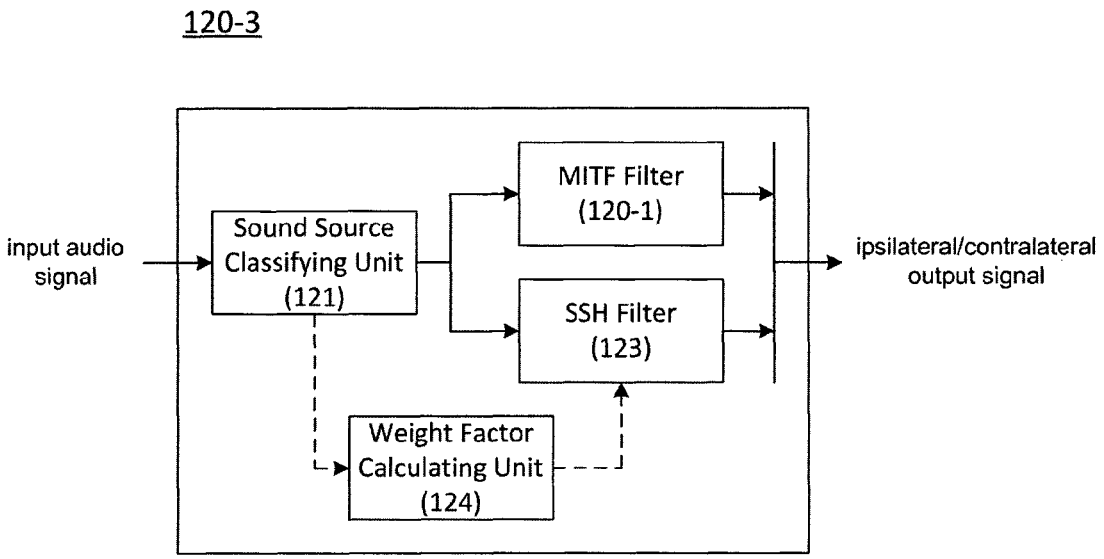
FIG. 9 is a block diagram of a direction renderer according to still another exemplary embodiment of the present invention.

FIG. 9 is a block diagram of a direction renderer according to still another exemplary embodiment of the present invention. According to an exemplary embodiment of FIG. 9, the direction renderer 120-3 includes a sound source classifying unit 121, an MITF filter 120-1, an SSH filter 123, and a weight factor calculating unit 124. Even though in FIG. 9, it is illustrated that the direction renderer 120-1 of FIG. 3 is used as the MITF filter, the present invention is not limited thereto and the direction renderer 120-2 of FIG. 7 may be used as the MITF filter.

In the case of a binaural signal which is synthesized using an impersonalized HRTF, a sound image localization and a tone are inversely proportional to each other. That is, when a signal which is synthesized to satisfactorily feel the altitude is compared with an original sound, the tone is significantly degraded. In order to overcome the above problem, the direction renderer 120-3 may employ sound spectral highlighting (SSH). According to an exemplary embodiment of the present invention, the direction renderer 120-3 may selectively employ the SSH based on at least one of a sound source characteristic, a spectrum characteristic, and rendering space information of the input audio signal.

FIG. 9 illustrates an exemplary embodiment in which the SSH is selectively applied in accordance with a sound source characteristic of the input audio signal. The direction renderer 120-3 determines whether a sound image localization of the input audio signal has a priority or the tone of the input audio signal has a priority, in accordance with the sound source characteristic of the input audio signal. When it is determined that the sound image localization of the input audio signal has the priority, the direction renderer 120-3 does not perform the sound spectral highlight filtering (SSH filtering), but filters the input audio signal using the MITF filter 120-1. In contrast, when it is determined that the tone of the input audio signal has a priority, the direction renderer 120-3 filters the input audio signal using the SSH filter 123. For example, the direction renderer 120-3 performs the SSH filtering on a sound effect signal whose change of the tone is not very important and does not perform the SSH filtering on a music signal in which lowering of the tone significantly affects the sound quality.

To this end, the sound source classifying unit 121 classifies the input audio signal based on information of the sound source characteristic extracted from the input audio signal. The information of the sound source characteristic of the input audio signal includes at least one of a time characteristic and a frequency characteristic of the input audio signal. The direction renderer 120-3 performs different filtering on the input audio signal based on the classifying result of the sound source classifying unit 121. In this case, the direction renderer 120-3 determines whether to perform the SSH filtering on the input audio signal based on the classifying result. According to an exemplary embodiment, the sound source classifying unit 121 classifies the input audio signal into a first signal and a second signal based on the information of the sound source characteristic extracted from the input audio signal. The direction renderer 120-3 performs the MITF filtering on the first signal and performs the SSH filtering on the second signal.

The input audio signal may be classified into a first signal and a second signal based on at least one of the time characteristic and the frequency characteristic extracted from the input audio signal. First, the input audio signal may be classified into a first signal or a second signal based on a length of the sound source. In game contents, a length of a sound effect such as a gun sound or a sound of a footstep is relatively shorter than that of the music. Therefore, when a sound source of the input audio signal is longer than a predetermined length, the sound source classifying unit 121 classifies the signal as a first signal and when the sound source is shorter than the predetermined length, classifies the signal as a second signal. Further, the input audio signal may be classified into a first signal or a second signal based on a frequency bandwidth of the sound source. Generally, the music is distributed in a broader frequency band than that of the sound effect. Therefore, when a frequency bandwidth of a sound source of the input audio signal is larger than a predetermined bandwidth, the sound source classifying unit 121 classifies the signal as a first signal and when the frequency bandwidth of the sound source is smaller than the predetermined bandwidth, classifies the signal as a second signal.

As another exemplary embodiment, the input audio signal may be classified into a first signal or a second signal based on whether the specific impulse signal is repeated. A sound effect such as a sound of helicopter or a sound of hand clapping has a characteristic in which a specific impulse signal is repeated. Therefore, when a specific impulse signal is repeated in the input audio signal, the sound source classifying unit 121 classifies the signal as a second signal. The direction renderer 120-3 classifies the input audio signal into a plurality of signals by combining at least one of the above-described exemplary embodiments and determines whether to perform the SSH filtering on the input audio signal based on the classifying result. According to another exemplary embodiment of the present invention, classification information of the input audio signal is transferred to the direction renderer 120-3 as metadata. The direction renderer 120-3 determines whether to perform the SSH filtering on the input audio signal based on the classifying information included in the metadata.

In the above-described exemplary embodiment, it is described that the input audio signal is classified into the first signal and the second signal to perform the MITF filtering and the SSH filtering on the signals, respectively, but the present invention is not limited thereto. According to another exemplary embodiment of the present invention, the input audio signal is classified into a plurality of predetermined signals and different filtering may be performed on each of the classified signals. Further, the direction renderer 120-3 performs both the MITF filtering and the SSH filtering on at least one of the classified signals.

The weight factor calculating unit 124 generates a weight factor which will be applied to the SSH filter 123 and transfers the weight factor to the SSH filter 123. The SSH filter 123 emphasizes the peak and/or notch component of the input audio signal using the weight factor. According to an exemplary embodiment of the present invention, the weight factor calculating unit 124 determines the weight factor to be applied to the SSH, based on the spectrum characteristic of the input audio signal, to minimize the degradation of the tone. The weight factor calculating unit 124 generates the weight factor based on magnitudes of a peak component and a notch component of the input audio signal. Further, the weight factor calculating unit 124 may set the weight factor in a specific frequency band which affects the altitude localization to be different from a weight factor in a different frequency band.

The weight factor calculating unit 124 determines a weight factor to be applied to H(k) based on a result of comparing magnitudes of HRTF H(k) corresponding to the input audio signal and a reference HRTF H_reference(k). According to an exemplary embodiment, H_reference(k)

may be obtained from at least one of an average value, a median value, an envelope average value, and an envelope median value of a HRTF set including H(k). The HRTF set includes H(k) and HRTF at an opposite side thereto. According to another exemplary embodiment, H_reference(k) may be a reference HRTF having a different direction from H(k) or an envelope component thereof. For example, H_reference (k) may be an HRTF having the same azimuth as H(k) and an altitude of zero or an envelope component thereof.

The weight factor calculating unit 124 determines a weight factor according to various exemplary embodiments. According to an exemplary embodiment, the weight factor calculating unit 124 measures a differential value of H(k) and H_reference(k) and generates a weight factor to emphasize a predetermined number of peaks and the notch in a descending order of the differential value. Further, when the differential value of H(k) and H_reference(k) is larger than a predetermined value, the weight factor calculating unit 124 may set the weight factor for the corresponding peak component or the notch component to be small, in order to prevent the degradation of the tone. According to another exemplary embodiment of the present invention, the weight factor calculating unit 124 measures a magnitude ratio of H(k) and H_reference(k) and generates the weight factor based on the measured magnitude ratio. The tone of the audio signal is significantly affected when the notch component is emphasized rather than when the peak component is emphasized. When a ratio of H(k) with respect to H_reference(k) is larger than 1, the weight factor calculating unit 124 determines the component as a peak component to allocate a high weight factor and when the ratio is smaller than 1, allocate a low weight factor. This will be mathematically expressed by the following Equation 16.

$$\text{if } (|H(k)/H_\text{reference}(k)|>1)$$

$$w_g(k)=\alpha$$

$$\text{else}$$

$$w_g(k)=\beta \qquad \text{[Equation 16]}$$

Herein, w_g(k) is a weight factor and $\alpha>\beta$.

That is, when a ratio of H(k) with respect to H_reference (k) is larger than 1, the weight factor w_g(k) is determined as a first factor $\alpha$ and when the ratio of H(k) with respect to H_reference(k) is smaller than 1, the weight factor w_g(k) is determined as a second factor $\beta$. In this case, the first factor $\alpha$ is larger than the second factor $\beta$. When the weight factor is determined as described above, the sound quality of the audio signal may be prevented from being degraded while maintaining the sound image localization performance. $\alpha$ and $\beta$ may be determined to be constant numbers or determined to have different values in accordance with the ratio of H(k) with respect to H_reference(k). Meanwhile, in the HRTF, a transfer function measured in a left ear and a transfer function measured in a right ear form a pair but when the SSH is applied, ILD information of the prototype HRTF may be distorted. Therefore, according to an exemplary embodiment, the weight factor calculating unit 124 may apply the same weight factor for each frequency to the left transfer function and the right transfer function.

<Distance Rendering>

When the audio signal is rendered in a three-dimensional space, a sound image may be localized in a specific position through convolution with HRTF which is measured in accordance with a direction and an altitude of the sound. However, HRTF database provided in the related art is generally measured at a specific distance. When the audio signal is rendered only using HRTF measured in a fixed position, a sense of space in a virtual space is not provided and a sense of distance of front/rear and left/right is missing. Therefore, in order to improve immersion in the virtual space, not only the direction and the altitude of the sound source but also the distance of the sound source needs to be considered. The audio signal processing apparatus of the present invention may perform not only direction rendering of the input audio signal, but also distance rendering. The distance rendering according to the exemplary embodiment of the present invention may be also referred to as advanced distance rendering (ADR) and collectively referred to as methods for improving a sense of distance in a virtual space. The following elements affect a listener recognizing a sense of distance of a sound object in a virtual space.

(1) Intensity—level change of sound in accordance with distance (2) Head shadowing—frequency attenuation characteristic due to diffraction, reflection, and scattering of sound by head (3) Initial time delay—travel time of the sound from sound object to the ears in accordance with initial distance (4) Doppler effect—frequency modulation by change of travel time of the sound to the ear in accordance with movement of the object (5) Motion parallax—degree of change of interaural binaural cue in accordance with distance (parallax)

(6) Direct to reverberation ratio (DRR)—volume ratio between direct sound and reverberation According to an exemplary embodiment of the present invention, the distance renderer performs the distance rendering on the input audio signal using at least one of the above elements as a distance cue.

Figure 10:
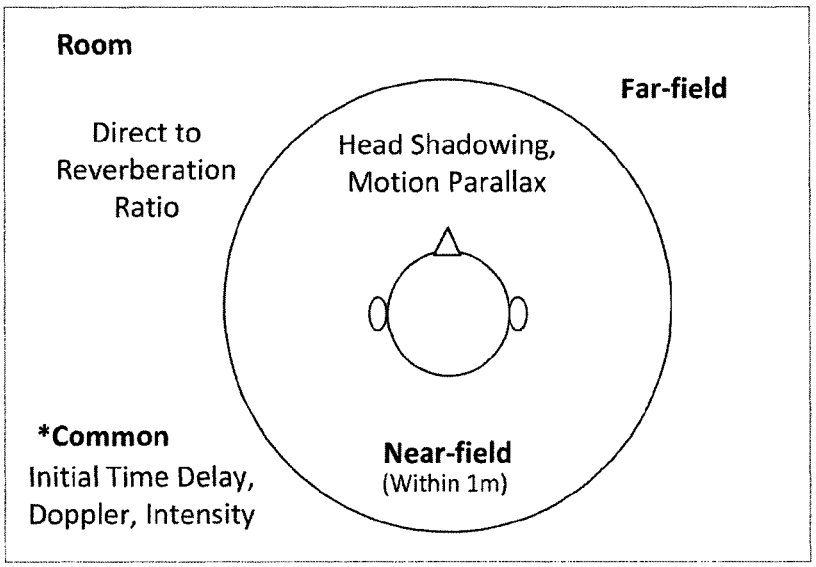
FIG. 10 is a diagram schematically illustrating a distance cue in accordance with a distance from a listener.

FIG. 10 schematically illustrates a distance que in accordance with a distance from a listener. A range where a human recognizes an exact distance of a sound source without having space information is limited to a specific distance. According to an exemplary embodiment of the present invention, a distance between the listener and the sound source is divided into a near field and a far field with reference to a predetermined distance. In this case, the predetermined distance may be a specific distance between 0.8 m and 1.2 m and may be 1 m according to an exemplary embodiment. The above elements may differently affect the listener recognizing the sense of distance in accordance with a distance between the sound source and the listener. For example, when the sound source is located in a near field from the listener, the head shadowing and the motion parallax significantly affect recognizing the sense of distance of the sound source. In contrast, when the sound source is located in a far field from the listener, the DRR may affect recognizing the sense of distance of the sound source. Meanwhile, the initial time delay, the Doppler effect, and intensity generally affect recognizing the sense of distance of the sound source regardless of the near field or the far field. However, the elements illustrated in FIG. 10 indicate predominant distance cues in the near field and the far field, but the present invention is not limited thereto. That is, the predominant elements in the near field may be used to recognize a sense of distance in the far field, and vice versa.

A method for performing distance rendering may be mainly classified into two methods. According to a first method, the rendering is performed using HRTFs actually measured at points with various distances and according to a second method, the rendering is performed using an HRTF actually measured at a point with a specific distance but the distance cues are additionally compensated. In this case, the specific distance may be one predetermined distance or a plurality of predetermined distances.

Figure 11:
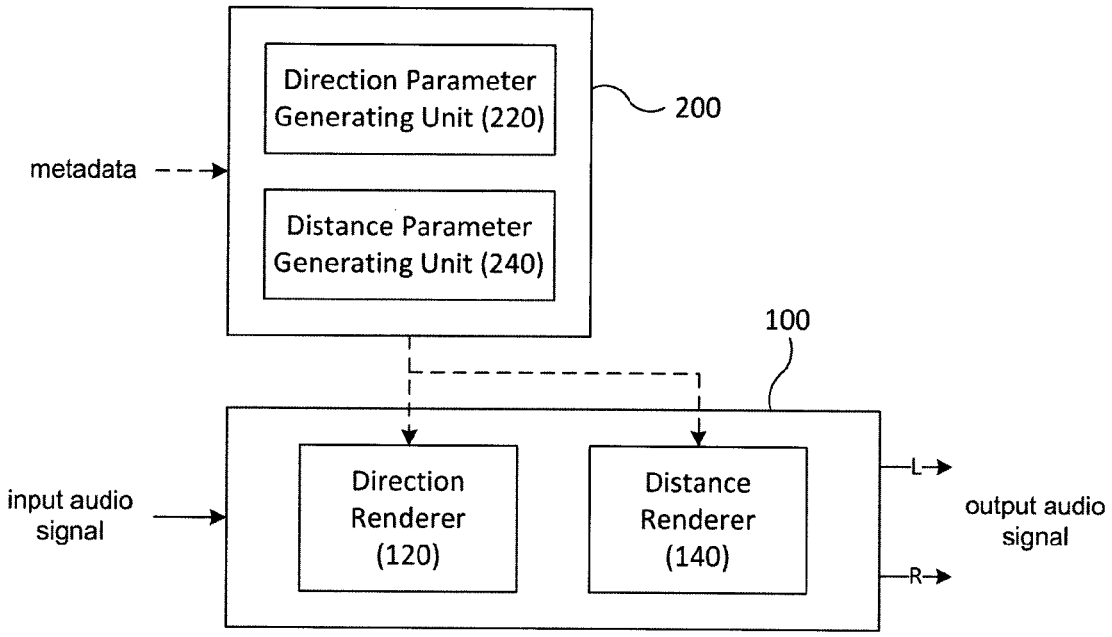
FIG. 11 is a diagram illustrating a binaural rendering method according to an exemplary embodiment of the present invention.

FIG. 11 is a diagram illustrating a binaural rendering method according to an exemplary embodiment of the present invention. Redundant description of parts of the exemplary embodiment of FIG. 11 which are the same as or correspond to the exemplary embodiment of FIG. 2 will be omitted.

A binaural renderer 100 for binaural rendering of an input audio signal includes a direction renderer 120 and a distance renderer 140. The binaural renderer 100 receives a binaural parameter from a binaural parameter controller 200 and performs rendering on the input audio signal based on the received binaural parameter. As described above, the direction renderer 120 performs direction rendering to localize a sound source direction of the input audio signal. Further, the distance renderer 140 performs distance rendering which reflects an effect in accordance with a sound source distance of the input audio signal.

The binaural parameter controller 200 receives metadata corresponding to the input audio signal and generates the binaural parameter using the received metadata. In this case, the metadata includes a direction, an altitude, a distance of a sound object which is included in the input audio signal and space information in which the sound object is reproduced. Further, the metadata may include at least one of space information of the listener, space information of an audio signal, and relative space information of the audio signal. The binaural parameter controller 200 includes a direction parameter generating unit 220 and a distance parameter generating unit 240. The direction parameter generating unit 220 generates a binaural parameter which is used in the direction renderer 120. According to an exemplary embodiment, the direction parameter generating unit 220 may indicates an MITF generating unit 220 of FIG. 4. Further, the distance parameter generating unit 240 generates a binaural parameter which is used in the distance renderer 140.

Each block illustrated in FIG. 11 indicates a logical configuration which performs the binaural rendering of the present invention and may be implemented by a chip in which at least one block is integrated according to an exemplary embodiment. Further, the binaural renderer 100 and the binaural parameter controller 200 may be implemented by separate devices or an integrated device.

Figure 12:
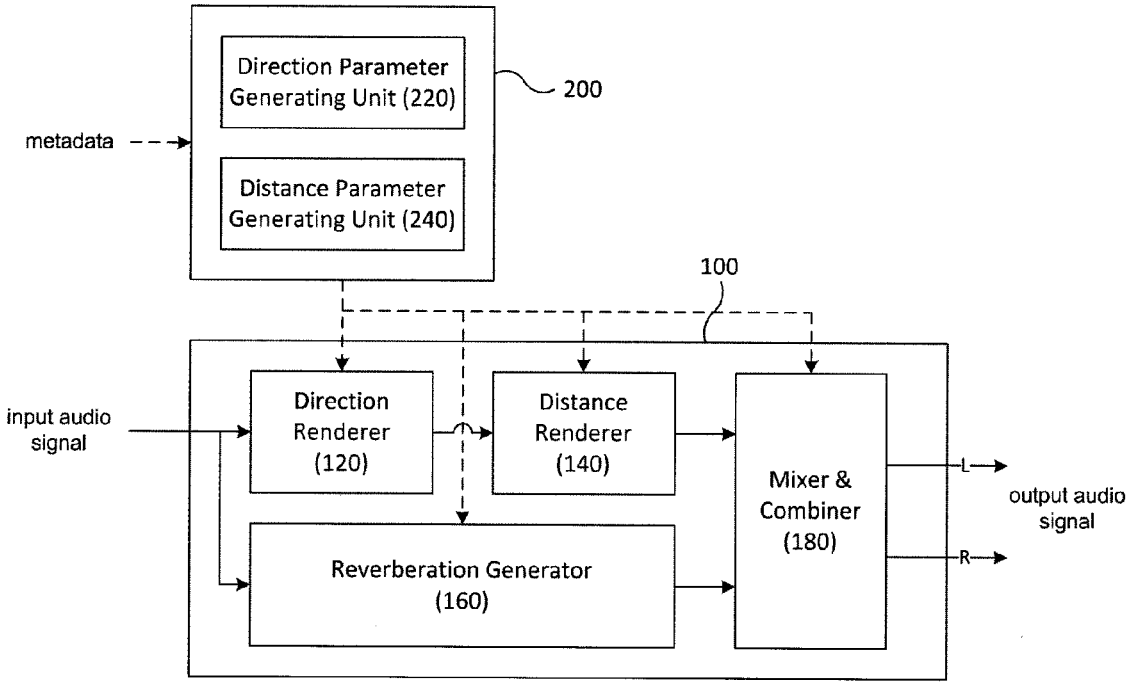
FIG. 12 is a diagram illustrating a binaural rendering method according to another exemplary embodiment of the present invention.

FIG. 12 is a diagram illustrating a binaural rendering method according to another exemplary embodiment of the present invention. Redundant description of parts of the exemplary embodiment of FIG. 12 which are the same as or correspond to the exemplary embodiment of FIG. 2 or 11 will be omitted.

According to the exemplary embodiment of FIG. 12, the binaural renderer 100 may further include a reverberation generator 160 and a mixer & combiner 180. The binaural parameter received from the binaural parameter controller 200 may be transferred to the reverberation generator 160 and the mixer & combiner 180. The reverberation generator 160 receives space information from the binaural parameter controller 200 and models the reflection sound in accordance with a space where the sound object is located to generate reverberation. In this case, the reverberation includes early reflection and late reverberation. The mixer & combiner 180 combines a direct sound generated by the direction renderer 120 and the distance renderer 140 and the reverberation generated by the reverberation generator 160 to generate an output audio signal.

According to an exemplary embodiment of the present invention, the mixer & combiner 180 adjusts a relative output magnitude of the direct sound and the reverberation of the output audio signal based on the direct to reverberation ratio (DRR). The DRR may be transferred in the form of free set or may be measured from a sound scene in a real time. DRR plays an important role to recognize a sense of distance of the sound source and specifically, helps the listener to recognize an absolute distance of the sound in a far field. When the sound source is located in a far field, the reverberation helps to recognize an exact sense of distance of the sound source and in contrast, when the sound source is located in a near field, the reverberation may interrupt to recognize the sense of distance of the sound source. Accordingly, in order to perform efficient distance rendering, the DRR needs to be appropriately adjusted based on distance information and space information of the sound source. According to the exemplary embodiment of the present invention, the DRR may be determined based on the distance cue of the sound source. That is, when the sound source is located in a near field, a level of the reverberation is set to be low as compared with the direct sound and when the sound source is located in a far field, the level of the reverberation is set to be high as compared with the direct sound. The distance cue of the sound source may be obtained from the metadata corresponding to the input audio signal.

When the sound source is located in a near field within a predetermined distance, importance of the reverberation may be lowered as compared with the direct sound. According to an exemplary embodiment, when the sound source of the input audio signal is located in a near field within a predetermined distance, the binaural renderer 100 may omit to generate the reverberation with respect to the input audio signal. In this case, since the reverberation generator 160 is not used, a computational complexity of the binaural rendering is reduced.

Meanwhile, when the direct sound generated using the HRTF and reverberation generated in the reverberation generator 160 are mixed as it is, the level of the output audio signal may not match the video scene or metadata information. Therefore, according to an exemplary embodiment of the present invention, the binaural renderer 100 may use DRR to match the output audio signal and the video scene.

According to another exemplary embodiment of the present invention, the mixer & combiner 180 adjusts the DRR of the output audio signal in accordance with an incident angle of the sound source. Since characteristics of ILD, ITD, head shadowing, and the like disappear from the median plane of the listener, it is difficult to consider a sound approaching the median plane to be closer than the sound located at the side. Accordingly, the mixer & combiner 180 may set the DRR to be high as the position of the sound source approaches the median plane. According to an exemplary embodiment, the DRR is set to be highest on the median plane and to be lowest on a coronal plane. Further, the DRR is set by interpolation of a value on the median plane and a value on the coronal plane at the angle between the median plane and the coronal plane.

Figure 13:
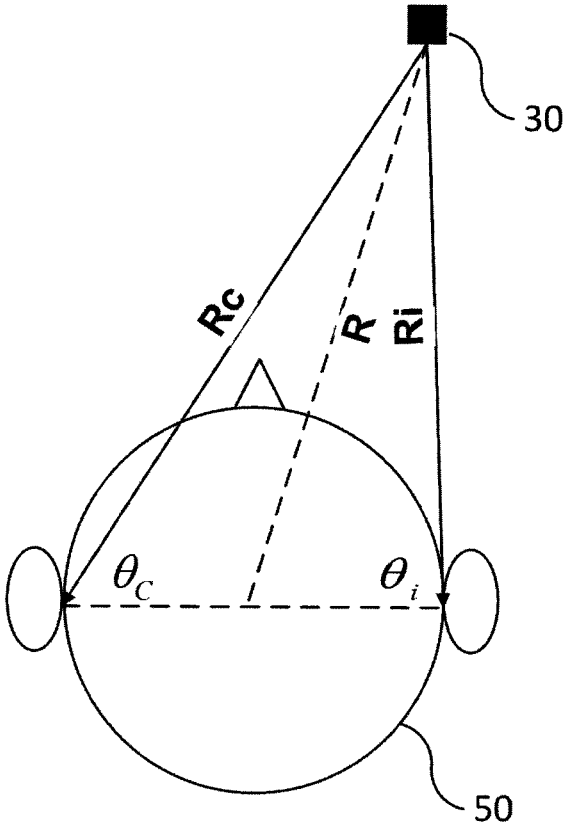
FIGS. 13 to 15 are diagrams illustrating direction rendering methods according to an additional exemplary embodiment of the present invention.
Figure 14:
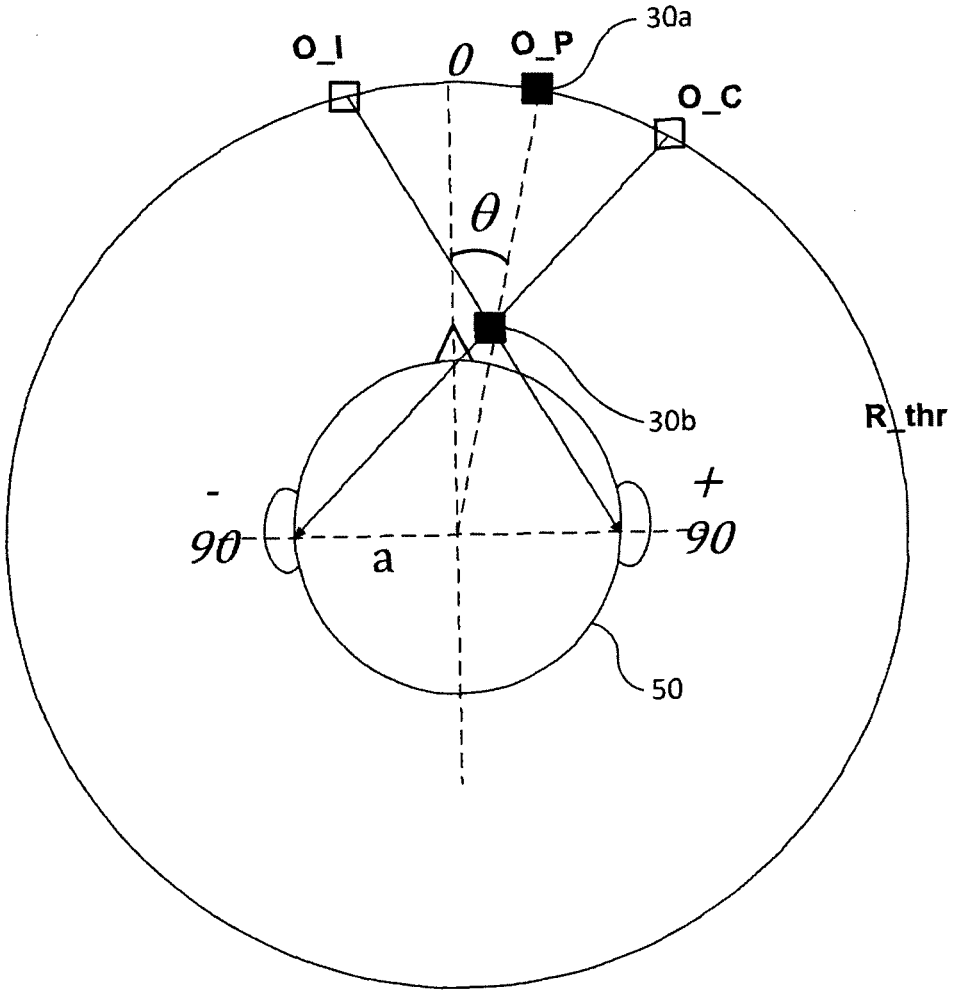

FIGS. 13 and 14 illustrate binaural rendering methods according to an additional exemplary embodiment of the present invention. The binaural rendering illustrated in FIGS. 13 and 14 is performed by the above-described binaural renderer 100 and a parameter for the binaural rendering may be generated by the binaural parameter controller 200.

<First Method of Binaural Rendering>

Binaural rendering according to a first exemplary embodiment of the present invention may be performed using HRTF in a predetermined distance. According to an exemplary embodiment, the predetermined distance may be a single fixed distance. The HRTF is measured at specific points in the predetermined distance from a head of a listener, and a left HRTF and a right HRTF form a set. A direction parameter generating unit generates an ipsilateral transfer function and a contralateral transfer function using the left HRTF and the right HRTF in a fixed distance corresponding to a position of the sound source and the binaural renderer performs the binaural rendering on the input audio signal using the generated ipsilateral and contralateral transfer functions to localize the sound image. According to the first exemplary embodiment of the present invention, the HRTF set in the fixed distance is used to perform the binaural rendering and the distance rendering using 1/R law may be performed to reflect an effect in accordance with a distance of the sound source.

<Second-One Method of Binaural Rendering—Binaural Rendering Considering Parallax 1>

Binaural rendering according to a second exemplary embodiment of the present invention may be performed in consideration of a parallax. In this case, when the sound source is located within a predetermined distance from the listener, the binaural rendering considering the parallax may be performed. Hereinafter, exemplary embodiments of the binaural rendering method which consider the parallax will be described with reference to FIGS. 13 to 15.

FIG. 13 illustrates a first exemplary embodiment of the binaural rendering considering parallax. When the sound source 30 is far from the listener 50, a difference between incident angles θc and θi from the sound source 30 to both ears of the listener 50 is not significant. However, when the sound source 30 is close to the listener 50, the difference between incident angles θc and θi from the sound source 30 to both ears of the listener 50 becomes large. Further, a degree of change of the incident angles θc and θi to both ears of the listener 50 as compared with the change of the position of the sound source 30 may vary depending on a distance R of the sound source 30, which is referred to as motion parallax. When the difference between incident angles θc and θi from the sound source 30 to both ears of the listener 50 is large, if the distance rendering based on the distance R of the sound source from a center of the head of the listener 50 is similarly applied to the ipsilateral and contralateral signals, an error may be caused.

According to an exemplary embodiment of the present invention, when the sound source 30 is located in a near field within a predetermined distance from the listener 50, the distance rendering may be performed based on distances Ri and Rc from the sound source 30 to the both ears of the listener 50. Ri is a distance (hereinafter, an ipsilateral distance) between the sound source 30 and an ipsilateral ear of the listener 50 and Rc is a distance (hereinafter, a contralateral distance) between the sound source 30 and a contralateral ear of the listener 50. That is, the binaural rendering on the ipsilateral signal is performed based on the ipsilateral distance Ri and the binaural rendering on the contralateral signal is performed based on the contralateral distance Rc. In this case, for the binaural rendering, an HRTF set corresponding to the position of the sound source 30 with respect to the center of the head of the listener 50 or a modified transfer function set thereof may be used. The binaural renderer filters the input audio signal with the ipsilateral transfer function and performs the distance rendering based on the ipsilateral distance Ri to generate an ipsilateral output signal. The binaural renderer filters the input audio signal with the contralateral transfer function and performs the distance rendering based on the contralateral distance Rc to generate a contralateral output signal. As described above, the binaural renderer applies different gains to both ears for the near field sound source so that a rendering error due to the parallax of the both ears may be reduced.

<Second-Two Method of Binaural Rendering—Binaural Rendering Considering Parallax 2>

Figure 15:
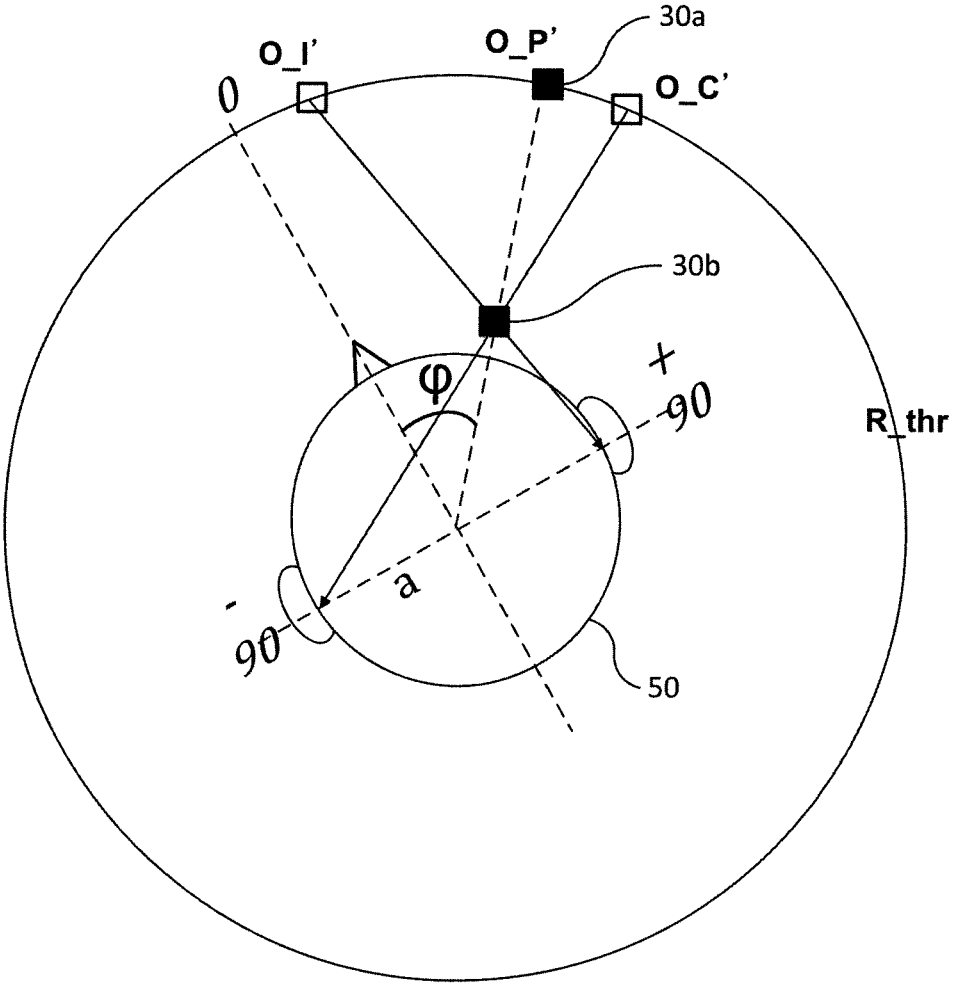

FIGS. 14 and 15 illustrate a second exemplary embodiment of binaural rendering considering the parallax. Generally, for the binaural rendering, a HRTF set corresponding to the positions of the sound sources 30*a* and 30*b* with respect to the center of the head of the listener 50 or a modified transfer function set thereof may be used. However, when the sound source 30*b* is located within a predetermined distance R_thr from the listener 50, it is desirable to use the HRTF with respect to both ears of the listener 50 for the binaural rendering, rather than the HRTF with respect to the center of the head of the listener 50.

For the convenience of description, reference symbols in the exemplary embodiments of FIGS. 14 and 15 are defined as follows. Reference symbol R_thr indicates a predetermined distance with respect to the center of the head of the listener 50 and reference symbol 'a' indicates a radius of the head of the listener 50. Θ and ϕ indicate incident angles of the sound sources 30*a* and 30*b* with respect to the center of the head of the listener 50. The distance and the incident angle of the sound source are determined in accordance with a relative position of the sound sources 30*a* and 30*b* with respect to the center of the head of the listener 50.

Reference symbols O_P, O_I, and O_C indicate specific positions of the sound sources where the HRTF is measured with respect to the listener 50. The HRTF sets corresponding to the positions of O_P, O_I, and O_C may be obtained from HRTF database. According to an exemplary embodiment, the HRTF sets obtained from the HRTF database may be HRTF sets for the points located in a predetermined distance R_thr with respect to the listener 50. In FIG. 14, reference symbol O_P is an HRTF point corresponding to an incident angle θ of the sound source 30*b* with respect to the center of the head of the listener 50. Further, reference symbol O_I is an HRTF point corresponding to an incident angle of the sound source 30*b* with respect to the ipsilateral ear of the listener 50 and reference symbol O_C is an HRTF point corresponding to an incident angle of the sound source 30*b* with respect to the contralateral ear of the listener 50. Reference symbol O_I is a point located in the predetermined distance R_thr with respect to the center of the head of the listener 50 on a straight line connecting the ipsilateral ear of the listener 50 and the sound source 30*b* and reference symbol O_C is a point located in the predetermined distance R_thr on a straight line connecting the contralateral ear of the listener 50 and the sound source 30*b*.

Referring to FIG. 14, the HRTF used for the binaural rendering may be selected based on the distance between the sound sources 30*a* and 30*b* and the listener 50. When the sound source 30*a* is located at a point where the HRTF is actually measured or outside the predetermined distance R_thr, the HRTF for binaural rendering of the sound source 30*a* is obtained from the HRTF set corresponding to the position of O_P. In this case, both the ipsilateral HRTF and the contralateral HRTF are selected from the HRTF set corresponding to the position of O_P. However, when the sound source 30*b* is located in a near field within the predetermined distance R_thr, the ipsilateral HRTF and the contralateral HRTF for the binaural rendering the sound source 30*b* are obtained from different HRTF sets. That is, the ipsilateral HRTF for the binaural rendering of the sound source 30*b* is selected from the ipsilateral HRTF among the HRTF set corresponding to the position of O_I and the contralateral HRTF for the binaural rendering of the sound source 30*b* is selected from the contralateral HRTF of the HRTF set corresponding to the position of O_C. The binaural renderer performs filtering on the input audio signal using the selected ipsilateral HRTF and contralateral HRTF.

As described above, according to an exemplary embodiment of the present invention, the binaural renderer performs the binaural rendering using the ipsilateral HRTF and the contralateral HRTF selected from different HRTF sets. The ipsilateral HRTF is selected based on the incident angle (that is, the ipsilateral incident angle) of the sound source 30*b* with respect to the ipsilateral ear of the listener 50 and the contralateral HRTF is selected based on the incident angle (that is, the contralateral incident angle) of the sound source 30*b* with respect to the contralateral ear of the listener 50. According to an exemplary embodiment, in order to estimate the ipsilateral incident angle and the contralateral incident angle, the head radius 'a' of the listener 50 may be used. The information of the head radius of the listener 50 may be received through the metadata or received through the user input. As described above, the binaural rendering is performed using the HRTF selected by reflecting different head sizes for each user, to apply a personalized motion parallax effect.

FIG. 15 illustrates a situation in which a relative distance of the sound sources 30*a* and 30*b* with respect to the center of the head of the listener 50 is changed from the exemplary embodiment of FIG. 14. When the sound object moves or the head of the listener 50 rotates, the relative position of the sound sources 30*a* and 30*b* with respect to the center of the head of the listener 50 changes. In an exemplary embodiment of the present invention, the rotation of the head of the listener 50 includes at least one of yaw, roll, and pitch. Therefore, reference symbols O_P, O_I, and O_C of FIG. 14 are changed to reference symbols O_P', O_I', and O_C', respectively. The binaural renderer performs the binaural rendering considering the motion parallax based on the changed O_P', O_I', and O_C' as described in the above exemplary embodiment.

In the exemplary embodiment of the present invention, the incident angle includes an azimuth and an altitude. Therefore, the ipsilateral incident angle includes an azimuth and an altitude (that is, the ipsilateral azimuth and the ipsilateral altitude) of the sound source for the ipsilateral ear of the listener 50 and the contralateral incident angle includes an azimuth and an altitude (that is, the contralateral azimuth and the contralateral altitude) of the sound source for the contralateral ear of the listener 50. When the head of the listener 50 rotates by yaw, roll, or pitch, at least one of the azimuth and altitude which configure the incident angle is changed.

According to an exemplary embodiment, the binaural renderer obtains the head rotation information of the listener 50, that is, information on at least one of the yaw, roll, and pitch. The binaural renderer calculates an ipsilateral incident angle, an ipsilateral distance, a contralateral incident angle, and a contralateral distance based on the obtained head rotation information of the listener 50. When the roll of the head of the listener 50 is changed, the altitudes of the sound sources with respect to both ears of the listener 50 become different from each other. For example, when the ipsilateral altitude becomes higher, the contralateral altitude becomes lower and when the ipsilateral altitude becomes lower, the contralateral altitude becomes higher. Further, when yawing of the head of the listener 50 is performed, the altitudes of the sound source with respect to the both ears of the listener 50 may be different from each other in accordance with the relative position of the listener 50 and the sound source.

The binaural renderer of the present invention selects the ipsilateral HRTF based on the ipsilateral azimuth and the ipsilateral altitude and selects the contralateral HRTF based on the contralateral azimuth and the contralateral altitude. When the relative position of the sound sources 30*a* and 30*b* with respect to the center of the head of the listener 50 is changed, the binaural renderer newly obtains the ipsilateral azimuth, the ipsilateral altitude, the contralateral azimuth, and the contralateral altitude and newly selects the ipsilateral HRTF and the contralateral HRTF based on the obtained angle information. According to an exemplary embodiment, when the head of the listener 50 rolls, altitude information for selecting a first HRTF set including the ipsilateral HRTF and altitude information for selecting a second HRTF set including the contralateral HRTF may be changed. When the altitude for selecting the first HRTF set becomes high, the altitude for selecting the second HRTF set may become low. Further, when the altitude for selecting the first HRTF set becomes low, the altitude for selecting the second HRTF set may become high. The change of information of the ipsilateral incident angle and the contralateral incident angle may be performed not only for the altitude but also the azimuth.

As described above, the binaural rendering considering the motion parallax may be complexively applied in accordance with the azimuth and the altitude of the sound object with respect to the listener 50. When the altitudes of the sound sources 30*a* and 30*b* change, a position of a notch and a magnitude of a peak of a transfer function which is used for the binaural rendering may be changed. Specifically, change of the position of the notch component significantly affects the altitude localization so that the binaural renderer compensates the notch component of the output audio signal using the notch filtering unit. The notch filtering unit extracts a notch component position of the ipsilateral and/or contralateral transfer function in accordance with the changed altitude of the sound sources 30*a* and 30*b* and performs the notch filtering on the ipsilateral and/or contralateral signal based on the extracted notch component position.

As described above, according to the exemplary embodiment of the present invention, when the sound source is located in a near field within a predetermined distance from the listener, the binaural rendering in consideration of the motion parallax may be performed. However, the present invention is not limited thereto, and regardless of whether the sound source is located in a near field or a far field from the listener, the binaural rendering considering the motion parallax may be performed.

<HRTF Interpolation>

For implementation of relative position change of the sound source in accordance with the motion of the head of the listener or movement of the sound object and for the binaural rendering considering parallax, HRTF data having a high resolution is required. However, when the HRTF database does not have HRTF data having a sufficient space resolution, interpolation of HRTF is required. According to an exemplary embodiment of the present invention, interpolation of the HRTF is performed using at least one of the following methods.

Linear interpolation

Discrete Fourier transform (DFT) interpolation

Spline interpolation

ILT/ITD interpolation

The binaural parameter controller combines a plurality of HRTFs to perform interpolation and the binaural renderer performs the binaural rendering using the interpolated HRTF. In this case, the interpolation of the HRTF may be performed using HRTF corresponding to a plurality of azimuths and altitudes. For example, in the case of the linear interpolation, the interpolation on the three-dimensional space may be implemented using HRTF values for at least three points. As a method for interpolating three HRTFs, three dimensional vector based amplitude panning (VBAP), inter-positional transfer function (IPTF) interpolation, and the like may be used. The method may reduce the computational complexity by approximately 25% as compared with bilinear interpolation which interpolates four HRTFs.

According to an additional exemplary embodiment, in order to minimize the increased computational complexity by the interpolation of the HRTF, the HRTF interpolation may be performed on a target region in advance. The binaural renderer includes a separate memory and stores the interpolated HRTF data in the memory in advance. In this case, the binaural renderer may reduce a computational complexity required for the real time binaural rendering.

Figure 16:
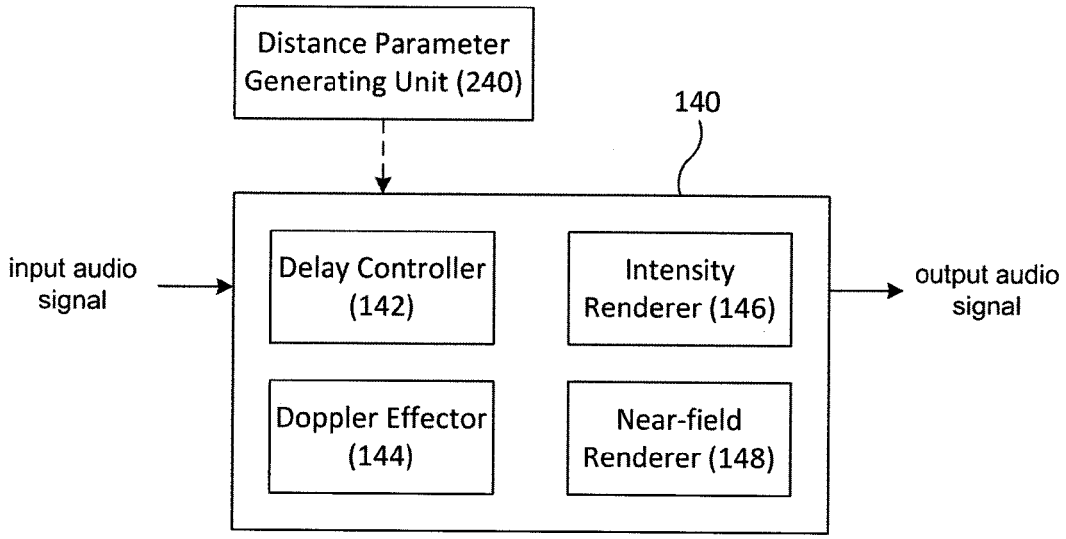
FIG. 16 is a block diagram of a distance renderer according to an exemplary embodiment of the present invention.

FIG. 16 is a block diagram of a distance renderer according to an exemplary embodiment of the present invention. Referring to FIG. 16, the distance renderer 140 includes a delay controller 142, a Doppler effector 144, an intensity renderer 146, and a near filed renderer 148. The distance renderer 140 receives a binaural parameter from a distance parameter generating unit 240 and performs distance rendering on an input audio signal based on the received binaural parameter.

First, the distance parameter generating unit 240 generates a binaural parameter for the distance rendering using metadata corresponding to the input audio signal. The metadata includes a direction (azimuth and altitude) of the sound source and the distance information. The binaural parameter for the distance rendering includes at least one of a distance (that is, the ipsilateral distance) from the sound source to the ipsilateral ear of the listener, a distance (that is, the contralateral distance) from the sound source to the contralateral ear of the listener, an incident angle (that is, the ipsilateral incident angle) of the sound source with respect to the ipsilateral ear of the listener, and an incident angle (that is, the contralateral incident angle) of the sound source with respect to the contralateral ear of the listener. Further, the binaural parameter for the distance rendering includes a distance scale value to adjust the strength of the effect of the distance rendering.

Figure 17:
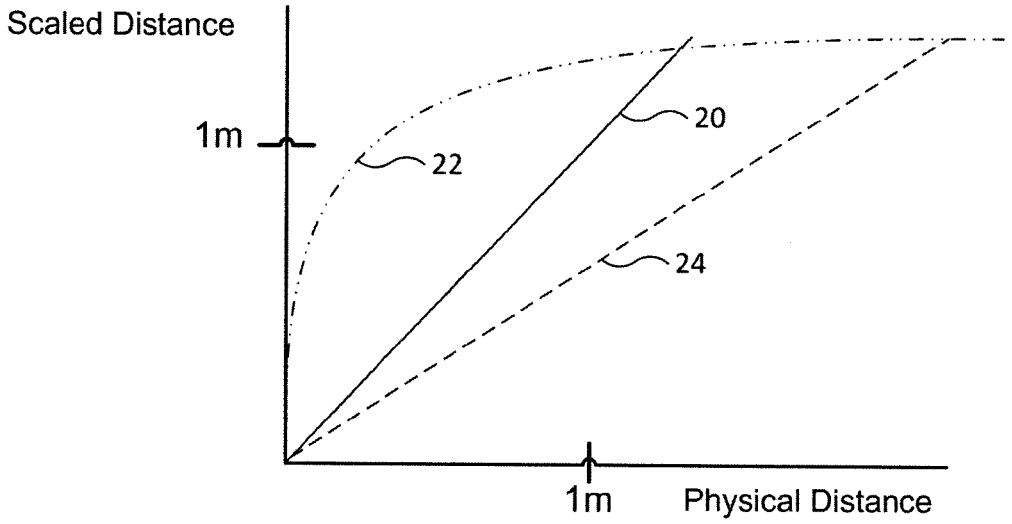
FIG. 17 is a graph illustrating a method for scaling distance information of a sound source.

According to an exemplary embodiment, the distance parameter generating unit 240 warps at least one of the direction and distance information of the sound source included in the metadata to strengthen a proximity effect of the sound source in a near field. FIG. 17 illustrates a method of scaling the distance information between the listener and the sound source as an exemplary embodiment thereof. In FIG. 17, a horizontal axis indicates a physical distance of the sound source with respect to the listener and a vertical axis indicates a scaled distance which is adjusted in accordance with the exemplary embodiment of the present invention. The distance parameter generating unit 240 scales the actual distance 20 of the sound source to calculate scaled distances 22 and 24. According to an exemplary embodiment, as the scaling, log scaling, exponent scaling, scaling using an arbitrary curve function may be used. In addition, the distance parameter generating unit 240 may calculate incident angles of the sound source with respect to both ears of the listener using position information of the sound source and information of a head size of the listener. The distance parameter generating unit 240 transfers the generated binaural parameter to the distance renderer 140.

Referring to FIG. 16 again, the delay controller 142 sets a delay time of the output audio signal based on an initial travel time of the sound in accordance with the distance between the sound source and the listener. According to an exemplary embodiment, the delay controller 142 performs a preprocessing step of the binaural renderer in order to reduce time complexity. In this case, the delay controller 142 may perform delay control on a mono signal corresponding to a sound source. According to another exemplary embodiment, the delay controller 142 performs the delay control on two channel output signals on which the binaural rendering is performed.

In consideration that the relative position of the sound source is changed, the delay time may be set based on a time when the sound source is generated or a time when a sound of the sound source starts to be heard by the listener. Further, the delay time is set based on the distance of the sound source from the listener and a sound speed. In this case, the sound speed may vary depending on an environment where the listener listens to the sound (for example, in the water or at a high altitude) and the delay controller 142 calculates a delay time using sound speed information in accordance with the environment of the listener.

The Doppler effector 144 models a change of the frequency of the sound generated when the relative distance of the sound source with respect to the listener changes. When the sound source becomes close to the listener, the frequency of the sound is increased and when the sound source becomes far from the listener, the frequency of the sound is lowered. The Doppler effector 144 implements the Doppler effect using resampling or a phase vocoder.

The resampling method changes the sampling frequency of the audio signal to implement the Doppler effect. However, a length of the audio signal may be smaller or larger than the length of a performing buffer and when the block processing is performed, a sample of a next block may be required due to the change of the frequency. In order to solve the problem, the Doppler effector 144 may perform additional initial buffering on one or more blocks in consideration of a frequency change width by the Doppler effect at the time of resampling.

The phase vocoder may be implemented using pitch shifting in a short-time Fourier transform (STFT). According to an exemplary embodiment, the Doppler effector 144 performs only the pitch shifting on a major band. Since the frequency of the sound is determined in accordance with the relative speed of the sound source, the amount of the frequency change may be flexible. Therefore, interpolation of pitch shifting is important to generate a natural Doppler sound. According to an exemplary embodiment, a pitch shift ratio may be determined based on a frequency change ratio. Further, in order to reduce sound distortion in an audio signal processing step in the unit of frame, a resampling degree and an interpolation resolution may be adaptively determined based on the frequency change ratio.

The intensity renderer 146 reflects change of a level of the sound (that is, a magnitude of the sound) in accordance with the distance between the sound source and the listener to the output audio signal. The intensity renderer 146 may perform the rendering based on an absolute distance between the sound source and the listener, or otherwise perform the rendering based on a predetermined head model. Further, the intensity renderer 146 may implement attenuation of the sound in consideration of air absorption. The intensity renderer 146 of the present invention performs the distance rendering according to various exemplary embodiments below.

<First Method of Intensity Renderer—1/R>

In order to adjust the intensity in accordance with the distance, the intensity renderer 146 may generally employ an inverse square law which increases an intensity of the sound as the distance between the sound source and the listener is reduced. In the present invention, the inverse square law may be referred to as 1/R law. In this case, R indicates a distance from the center of the head of the listener to the center of the sound source. For example, the intensity renderer 146 increases the intensity of the sound by 3 dB when the distance between the sound source and the listener is reduced to be half the distance. However, according to another exemplary embodiment of the present invention, a scaled distance which is adjusted by log or exponential function as illustrated in FIG. 17 may be used as the distance R between the sound source and the listener. Meanwhile, in the exemplary embodiment of the present invention, the intensity may be replaced by a terminology such as a volume or a level.

<Second Method of Intensity Renderer—1/R with Parallax>

The intensity is a factor which significantly affects the sense of distance of the object sound. However, when the same intensity gain is applied to both ears based on the distance of the sound source from the center of the head of the listener, it is difficult to reflect the sudden ILD increase in the near field. Therefore, according to an exemplary embodiment of the present invention, the intensity renderer 146 individually adjusts an ipsilateral intensity gain and a contralateral intensity gain based on the distance of the sound source with respect to both ears of the listener. This will be mathematically expressed by the following Equation 17.

$$B\hat{}I_DSR(k)=(1/\text{Effector}(Ri))*D\hat{}I(k)$$

$$B\hat{}C_DSR(k)=(1/\text{Effector}(Rc))*D\hat{}C(k)$$

$$Ri=\text{sqrt}(a^2+R^2-2*a*R*\cos(\theta+90))$$

$$Rc=\text{sqrt}(a^2+R^2-2*a*R*\cos(90-\theta)) \quad \text{[Equation 17]}$$

In Equation 17, D^I(k) and D^C(k) are an ipsilateral input signal and a contralateral input signal of the intensity renderer 146, respectively and B^I_DSR(k) and B^C_DSR (k) are an ipsilateral output signal and a contralateral output signal of the intensity renderer 146, respectively. Effector( ) is a function which outputs an intensity gain corresponding to the input distance and outputs a high gain as the input distance value is larger. Further, k indicates a frequency index.

Ri is a distance (that is, the ipsilateral distance) from the sound source to the ipsilateral ear of the listener and Rc is a distance (that is, the contralateral distance) from the sound source to the contralateral ears of the listener. Reference symbol 'a' indicates a radius of a head of a listener and reference symbol R indicates a distance (that is, a center distance) from the sound source to the center of the head of the listener. θ indicates an incident angle of a sound source with respect to the center of the head of the listener and according to an exemplary embodiment, indicates an incident angle of the sound source which is measured in a state when the contralateral ear and the ipsilateral ear of the listener are 0 degree and 180 degrees, respectively.

As represented in Equation 17, the ipsilateral gain and the contralateral gain for the distance rendering is determined based on the ipsilateral distance Ri and the contralateral distance Rc, respectively. Each of the ipsilateral distance Ri and the contralateral distance Rc are calculated based on the incident angle θ, a central distance R of the sound source, and a radius 'a' of the head of the listener. The information of the head radius of the listener may be received through the metadata or received through the user input. Further, the information of the head radius of the listener may be set based on an average head size in accordance with race information of the listener. When the sound source is located in a far field outside a predetermined distance from the listener, the intensity renderer 146 sets the head radius of the listener so as not to affect the ILD change of the both ears and when the sound source is located in a near field within a predetermined distance from the listener, the intensity renderer 146 models the sudden ILD increase based on the difference between the ipsilateral distance and the contralateral distance in accordance with the head radius of the listener. Each of the ipsilateral distance Ri and the contralateral distance Rc may be set to be a distance considering diffraction by the head of the listener, rather than a straight line distance between the sound source and the both ears of the listener. The intensity renderer 146 applies the calculated ipsilateral gain and contralateral gain to the ipsilateral input signal and the contralateral input signal, respectively, to generate the ipsilateral output signal and the contralateral output signal.

According to an additional exemplary embodiment of the present invention, the intensity renderer 146 models the attenuation of the sound in consideration of air absorption. In Equation 17, it is described that the input signal of the intensity renderer 146 is two channel ipsilateral and contralateral signals D^I(k) and D^C(k), but the present invention is not limited thereto. That is, the input signal of the intensity renderer 146 may be a signal corresponding to an object and/or a channel and in this case, D^I(k) and D^C(k) may be replaced with the same input signal corresponding to a specific object or channel in Equation 17. The second method of the intensity renderer may be implemented both in the time domain and the frequency domain.

<Third Method of Intensity Renderer—Applying Gain Using Head Model>

It is hard for the HRTF database to include HRTF data which is actually measured in all distances, so that in order to obtain response information of the HRTF in accordance with a distance, a mathematical model such as a spherical head model (SHM) may be used. According to an exemplary embodiment of the present invention, the intensity gain may be modeled based on the frequency response information in accordance with the distance of the mathematical model. All the distance cues such as intensity, head shadowing, and the like are reflected to the spherical head model. Therefore, when only the intensity is modeled using the spherical head model, a value of a low frequency band (a DC component) which is less affected by the attenuation of the sound or reflection characteristic is undesirably determined as the intensity value. Therefore, according to an exemplary embodiment of the present invention, a following weight function is additionally applied to perform the intensity rendering based on the spherical head model. In the exemplary embodiment of Equation 18, redundant description of definition of variables which are explained through the exemplary embodiment of Equation 17 will be omitted.

$$B\hat{}I_DSR(k)=(1/Ri)^{\alpha}*D\hat{}I(k)$$

$$B\hat{}C_DSR(k)=(1/Rc)^{\alpha}*D\hat{}C(k)$$

$$\alpha=R_tho \quad \text{[Equation 18]}$$

Herein, R_tho is an adjusted central distance and has a larger value than the central distance R. R_tho is a value for reducing an approximation error of the spherical head model, and set to be a distance at which the HRTF is actually measured or otherwise a specific distance designated in accordance with the head model.

As represented in Equation 18, the ipsilateral gain and the contralateral gain for the distance rendering are determined based on the ipsilateral distance Ri and the contralateral distance Rc. More specifically, the ipsilateral gain is determined based on a value of an inverse number of the ipsilateral distance Ri raised to the power of R_tho and the contralateral gain is determined based on a value of the contralateral distance Rc raised to the power of R_tho. The rendering method according to the exemplary embodiment of Equation 18 may be applied not only to the DC component, but also to the input signal of a different frequency region. The intensity renderer 146 applies the calculated ipsilateral gain and contralateral gain to the ipsilateral input signal and the contralateral input signal, respectively, to generate the ipsilateral output signal and the contralateral output signal.

According to another exemplary embodiment of the present invention, the distance rendering may be performed based on a ratio of the ipsilateral distance and the contralateral distance. This will be mathematically expressed by the following Equation 19. In the exemplary embodiment of Equation 19, redundant description of definition of variables which are explained through the exemplary embodiment of Equations 17 and 18 will be omitted.

$$B\hat{}I_DSR(k)=G*(Rc/Ri)^{\alpha}*D\hat{}I(k)$$

$$B\hat{}C_DSR(k)=G*D\hat{}C(k) \quad \text{[Equation 19]}$$

Herein, G is a gain extracted from the contralateral transfer function of the spherical head model and determined by the DC component value or an average value of the entire response. That is, the ipsilateral gain is determined as a value obtained by multiplying a value of a ratio of the contralateral distance Rc with respect to the ipsilateral distance Ri raised to the power of R_tho and the gain G and the contralateral gain is determined as the gain G. As described above, in the exemplary embodiment of Equation 19, the ipsilateral and the contralateral may be interchangeably applicable. The mathematical model used in the exemplary embodiment of the present invention is not limited to the spherical head model and also includes a snowman model, a finite difference time domain method (FDTDM), a boundary element method (BEM), and the like.

Next, a near-field renderer 148 reflects a frequency characteristic which changes in accordance with a position of the sound source in the near field to the output audio signal. The near-field renderer 148 may apply the proximity effect of the sound and head shadowing to the output audio signal. The proximity effect indicates a phenomenon in which when the sound source becomes close to the listener, a level of the low frequency band which is heard in the ipsilateral ears of the listener is increased. Further, the head shadowing is a phenomenon in which a course of the sound source is blocked by the head to be mainly occurred in the contralateral ear and the attenuation is significant in the high frequency band in accordance with the attenuation characteristics. Even though the head shadowing is significantly occurred in the contralateral ears, the head shadowing may be occurred in both ears in accordance with the position of the sound source like the case in which the sound source is in front of the listener. Generally, HRTF does not reflect the proximity effect and reflects only the head shadowing at a measured point.

Therefore, according to an exemplary embodiment of the present invention, the near-field renderer 148 performs the filtering which reflects the proximity effect and the head shadowing on the input audio signal. This will be mathematically expressed by the following Equation 20.

$$HD\hat{}I(k)=H_pm(k)*ID\hat{}I(k)$$

$$HD\hat{}C(k)=H_hs(k)*ID\hat{}C(k) \quad \text{[Equation 20]}$$

In Equation 20, ID^I(k) and ID^C(k) are an ipsilateral input signal and a contralateral input signal of the near-field renderer 148, respectively and HD^I(k) and HD^C(k) are an ipsilateral output signal and a contralateral output signal of the near-field renderer 148, respectively. H_pm(k) is a filter which reflects the proximity effect and H_hs(k) is a filter which reflects the head shadowing. Further, k indicates a frequency index.

That is, the near-field renderer 148 performs filtering which reflects the proximity effect to the ipsilateral input signal and performs filtering which reflects the head shadowing to the contralateral input signal. The filter H_pm(k) which reflects the proximity effect is a filter which amplifies a low frequency band of an audio signal and according to an exemplary embodiment, a low shelving filter may be used therefor. The filter H_hs(k) which reflects the head shadowing is a filter which attenuates a high frequency wave of an audio signal and according to an exemplary embodiment, a low pass filter may be used therefor. H_pm(k) and H_hs(k) may be implemented by an FIR filter or an IIR filter. Further, the H_pm(k) and H_hs(k) may be implemented through curve fitting based on a modeling function with respect to the distance and the frequency response of the actually measured near-field HRTF. As described above, filtering which reflects the frequency characteristic to the ipsilateral signal and the contralateral signal is referred to as frequency shaping in the present invention.

In order to perform the frequency shaping, the frequency response needs to be continuously changed in accordance with the distances of the sound source with respect to the both ears and an incident angle. Further, when the sound source moves across the median plane to change the ipsilateral side and the contralateral side with respect to the listener, the target signals of H_pm(k) and H_hs(k) are changed, so that distortion of discontinuous sound may be generated.

Therefore, according to an exemplary embodiment of the present invention, the near-field renderer 148 performs the filtering on the input audio signal with the function represented in the following Equation 21 based on the distance and the incident angle of the sound source with respect to the listener.

$$BFS_I(k)=(ai*k+bi)/(k+bi)$$

$$BFS_C(k)=(ac*k+bc)/(k+bc) \quad \text{[Equation 21]}$$

Herein, BFS_I(k) and BFS_C(k) are filters for binaural frequency shaping (BFS) of the input audio signal and may be implemented by rational functions for filtering the ipsilateral input signal and the contralateral input signal, respectively. ai and bi are coefficients generated based on the ipsilateral distance and the ipsilateral incident angle of the sound source and ac and be are coefficients generated based on the contralateral distance and the contralateral incident angle of the sound source. The near-field renderer 148 filters the ipsilateral input signal using a rational function BFS_I(k) having a coefficient obtained based on the ipsilateral distance and the ipsilateral incident angle and filters the contralateral input signal using a rational function BFS_C(k) having a coefficient obtained based on the contralateral distance and the contralateral incident angle.

According to the exemplary embodiment of the present invention, the coefficients may be obtained by fitting based on the distance and the incident angle. Further, according to another exemplary embodiment of the present invention, a filter for BFS of the input audio signal may be implemented by another function such as a polynomial function or an exponential function. In this case, the filter for BFS has a characteristic which models the above proximity effect and the head shadowing together. According to an additional exemplary embodiment of the present invention, the near-field renderer 148 obtains a table having the distance and the incident angle as an index and interpolates the table information based on the input metadata to perform the BFS, thereby lowering complexity of the operation.

As described above, according to the exemplary embodiment of FIG. 16, the distance renderer 140 combines above-described various exemplary embodiments to perform the distance rendering. According to an exemplary embodiment of the present invention, gain application and/or frequency shaping for the distance rendering may also be referred to as filtering using a distance filter. The distance renderer 140 determines an ipsilateral distance filter based on the ipsilateral distance and the ipsilateral incident angle and determines a contralateral distance filter based on the contralateral distance and the contralateral incident angle. The distance renderer 140 filters the input audio signal with the determined ipsilateral distance filter and contralateral distance filter to generate an ipsilateral output signal and a contralateral output signal. The ipsilateral distance filter adjusts at least one of the gain and the frequency characteristic of the ipsilateral output signal and the contralateral distance filter adjusts at least one of the gain and the frequency characteristic of the contralateral output signal.

Meanwhile, FIG. 16 is an exemplary embodiment illustrating elements of the distance renderer 140 of the present invention, but the present invention is not limited thereto. For example, the distance renderer 140 of the present invention may further include an additional element other than the elements illustrated in FIG. 16. Further, some elements illustrated in FIG. 16 may be omitted from the distance renderer 140. A rendering order of the elements of the distance renderer 140 may be changed or implemented by combined filtering.

Figure 18:
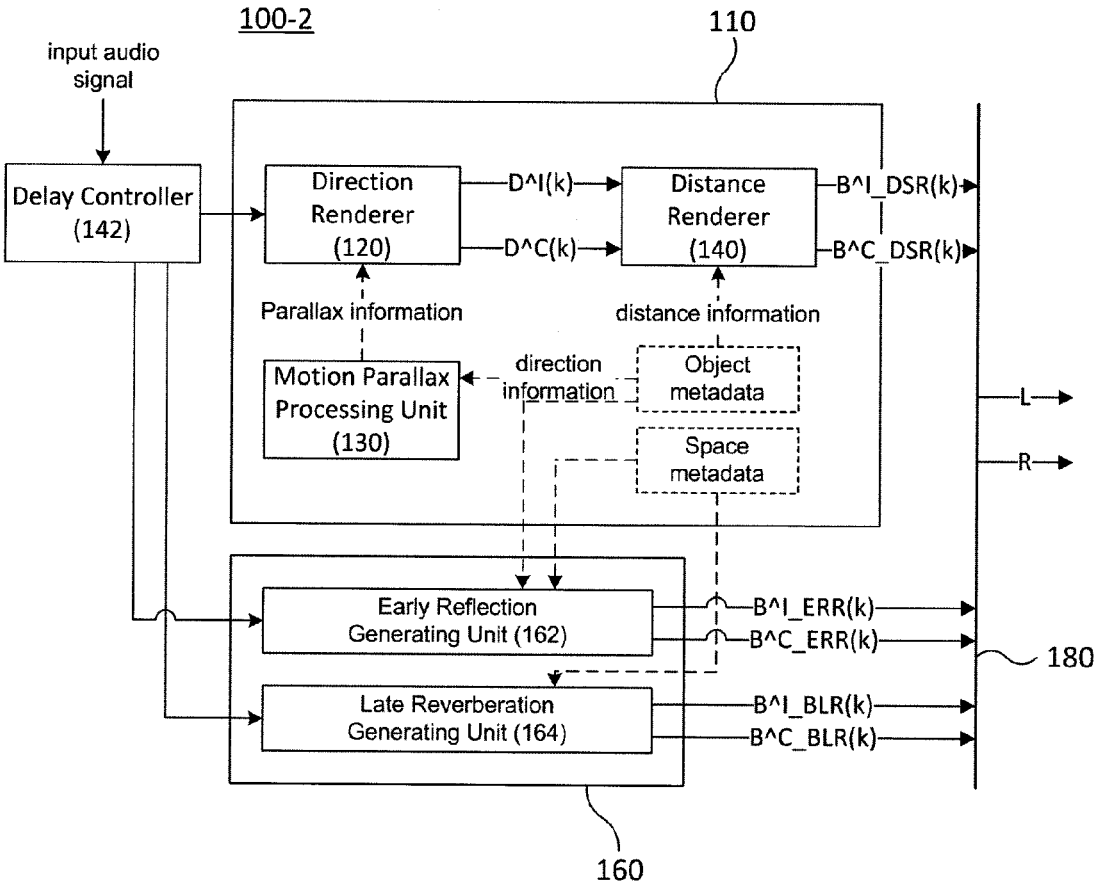
FIG. 18 is a block diagram illustrating a binaural renderer including a direction renderer and a distance renderer according to an exemplary embodiment of the present invention.

FIG. 18 is a block diagram illustrating a binaural renderer including a direction renderer and a distance renderer according to an exemplary embodiment of the present invention. The binaural renderer 100-2 of FIG. 18 performs binaural rendering by combining the direction rendering and the distance rendering of the above-described exemplary embodiment.

Referring to FIG. 18, the direction renderer 120 and the distance renderer 140 may configure a direct sound renderer 110. The direct sound renderer 110 performs binaural filtering on the input audio signal to generate two channel output audio signals B^I_DSR(k) and B^C_DSR(k). Further, the binaural renderer 100-2 may include a reverberation generator 160 which generates a reverberation of the input audio signal. The reverberation generator 160 includes an early reflection generating unit 162 and a late reverberation generating unit 164. The early reflection generating unit 162 and the late reverberation generating unit 164 generate early reflection B^I_ERR(k) and B^C_ERR(k) and late reverberation B^I_BLR(k) and B^C_BLR(k), respectively, using object metadata and spatial metadata corresponding to the input audio signal.

The mixer & combiner 180 combines a direct sound output signal generated by the direct sound renderer 110 and the indirect sound output signal generated by the reverberation generator 160 to generate final output audio signals L and R. According to an exemplary embodiment, as described above, the mixer & combiner 180 adjusts a relative output level of the direct sound and the indirect sound of the output audio signal based on the DRR. The mixer & combiner 180 applies DRR to both of the early reflection output signal and the late reverberation output signal, or applies the DRR to any one of the signals and performs mixing thereafter. Whether to apply the DRR to each of the early reflection and the late reverberation may be determined based on whether the sound source is located in a near-field from the listener.

When the binaural renderer 100-2 receives the input audio signal, the delay controller 142 sets a delay time of the audio signal. The delay time setting of the audio signal may be performed as a preprocessing step of the binaural rendering, but according to another exemplary embodiment, may be performed as a post processing step of the binaural rendering. Time delay information by the delay controller 142 is transferred to the direct sound renderer 110 and the reverberation generator 160 to be used for the rendering.

A direction renderer 120 filters the input audio signal with an ipsilateral transfer function and the contralateral transfer function, respectively, to generate output signals D^I(k) and D^C(k). The direction renderer 120 performs the direction rendering using the transfer function according to the above-described various exemplary embodiments as a direction filter. The ipsilateral transfer function and the contralateral transfer function of the above-described exemplary embodiments may also be referred to as an ipsilateral direction filter and a contralateral direction filter, respectively. The ipsilateral direction filter and the contralateral direction filter may be obtained from the HRTF set corresponding to a relative position of the sound source with respect to the center of the head of the listener. The position information is extracted from the object metadata and includes relative direction information and distance information of the sound source. When the sound source is located in a near-field from the listener, the ipsilateral direction filter and the contralateral direction filter may be determined based on the ipsilateral incident angle and the contralateral incident angle, respectively. In this case, the ipsilateral direction filter and the contralateral direction filter may be obtained from the HRTF sets corresponding to different positions, respectively.

A motion parallax processing unit 130 extracts information of the ipsilateral incident angle and the contralateral incident angle based on the relative position information of the sound source and the head size information of the listener and transfers the extracted information to the direction renderer 120. The direction renderer 120 may select the ipsilateral direction filter and the contralateral direction filter based on parallax information, that is, information of the ipsilateral incident angle and the contralateral incident angle transferred from the motion parallax processing unit 130.

The motion parallax processing unit 130 further extracts the ipsilateral distance and the contralateral distance information as parallax information based on the relative position information of the sound source and the head size information of the listener. The parallax information extracted from the motion parallax processing unit 130 is transferred to the distance renderer 140 and the distance renderer 140 may determine the ipsilateral distance filter and the contralateral distance filter based on the obtained parallax information.

A distance renderer 140 receives output signals D^I(k) and D^C(k) of the direction renderer 120 as input signals and performs the distance rendering on the received input signals to generate output audio signals B^I_DSR(k) and B^C_DSR(k). A specific distance rendering method of the distance renderer 140 is as described in FIG. 16.

As described above, the processing order of the direction renderer 120 and the distance renderer 140 may be changed. That is, the processing of the distance renderer 140 may be performed prior to the processing of the direction renderer 120. In this case, the distance renderer 140 performs the distance rendering on the input audio signal to generate two channel output signals d^I and d^C and the direction renderer 120 performs the direction rendering on d^I and d^C to generate two channel output audio signals B^I_DSR(k) and B^C_DSR(k). The distance rendering of the input audio signal in the exemplary embodiment of the present invention may refer to distance rendering of an intermediate signal on which the direction rendering is performed on the input audio as a preprocessing step. Similarly, the direction rendering of the input audio signal in the exemplary embodiment of the present invention may refer to direction rendering of an intermediate signal on which the distance rendering is performed on the input audio as a preprocessing step.

In the specification, the direction rendering and the distance rendering are described as separate processings, but the direction rendering and the distance rendering may be implemented by combined processing. According to an exemplary embodiment, the binaural renderer 100-2 determines the ipsilateral transfer function and the contralateral transfer function for direction rendering and obtains the ipsilateral distance filter and the contralateral distance filter for distance rendering. The binaural renderer 100-2 reflects gain and/or frequency characteristic information of the ipsilateral distance filter to the ipsilateral transfer function to generate the ipsilateral binaural filter and reflects gain and/or frequency characteristic information of the contralateral distance filter to the contralateral transfer function to generate the binaural filter. The binaural renderer 100-2 filters the input audio signal using the ipsilateral binaural filter and the contralateral binaural filter generated as described above to implement combined binaural rendering.

Meanwhile, according to another exemplary embodiment of the present invention, distance rendering may be performed through modeling of a distance variation function (DVF). As a method for applying a near-field HRTF characteristic to a far-field HRTF, there is a DVF using a spherical head model. This will be mathematically expressed by the following Equation 22.

$$NF_H(r_n,k)=DVF(r_n,k)*H(r_f,k)$$

$$DVF(r_n,k)=SHM(r_n,k)/SHM(r_f,k) \quad \text{[Equation 22]}$$

Herein, H( ) indicates an actually measured HRTF and NF_H( ) indicates a modeled near-field HRTF. r_n is a modeling target distance and r_f indicates a distance in which the HRTF is actually measured. Further, SHM( ) indicates a spherical head model. The DVF may implement near-field effect of the sound under an assumption that a frequency response of the spherical head model SHM( ) matches a frequency response of the actually measured HRTF H( ). However, when a Hankel function or Legendre function is used for the spherical head model, it is difficult to implement the distance rendering in real time due to a complex operation. Therefore, according to an exemplary embodiment of the present invention, the intensity renderer and the near-field renderer are combined to model the DVF.

Figure 19:
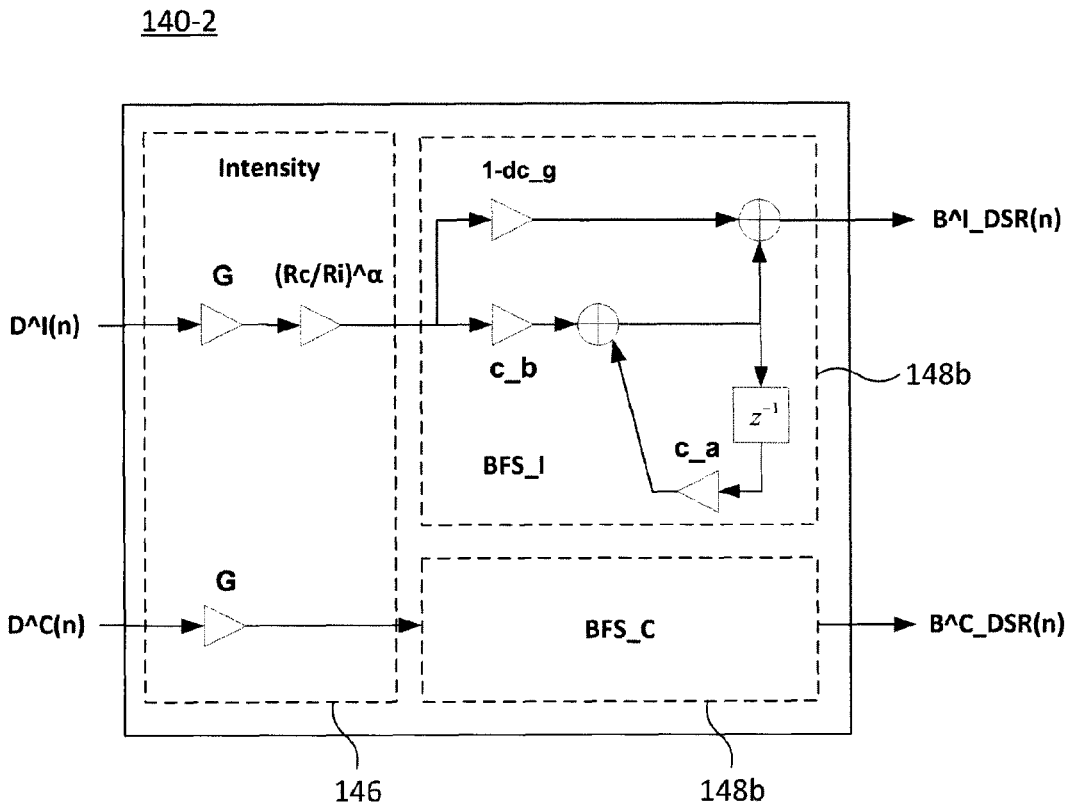
FIG. 19 is a block diagram of a distance renderer of a time domain according to an exemplary embodiment of the present invention.

FIG. 19 is a block diagram of a distance renderer of a time domain according to an exemplary embodiment of the present invention. The distance renderer 140-2 includes an intensity renderer 146 and near-field renderers 148*a* and 148*b*. FIG. 19 illustrates a distance renderer 140-2 which models the DVF in the time domain, but the present invention is not limited thereto and the distance renderer of the frequency domain may be also implemented by a similar method.

Referring to FIG. 19, the distance renderer 146 performs the distance rendering on the input audio signals D^I(n) and D^C(n) as represented in the following Equation 23. In the exemplary embodiment of Equation 23, redundant description of definition of variables which are explained through the exemplary embodiment of Equation 19 will be omitted.

$$B\hat{}I_DSR(n)=G*(Rc/Ri)^{\alpha}*\mathrm{conv}(D\hat{}I(n),BFS_I(n))$$

$$B\hat{}C_DSR(n)=G*\mathrm{conv}(D\hat{}C(n),BFS_C(n)) \quad \text{[Equation 23]}$$

In Equation 23, D^I(k) and D^C(k) are an ipsilateral input signal and a contralateral input signal of the distance renderer 140-2, respectively and B^I_DSR(k) and B^C_DSR(k) are an ipsilateral output signal and a contralateral output signal of the distance renderer 140-2, respectively. Further, BFS_I(n) indicates an ipsilateral frequency shaping function and BFS_C(n) indicates a contralateral frequency shaping function, and n is a sample index of the time domain.

G is a gain extracted from the contralateral DVF and determined by a DC component value or an average value of the overall response. According to an exemplary embodiment, G is determined based on curve fitting in accordance with a distance and an incident angle of the sound source or based on a table obtained through the spherical head model. According to an exemplary embodiment of the present invention, the ipsilateral gain and the contralateral gain are not simply increased together as the sound source approaches, but a level of the ipsilateral gain to the contralateral gain is increased thereby adjusting the ILD.

The near-field renderers 148*a* and 148*b* in the time domain, that is, a BFS filter is modeled to a primary IIR filter based on the distance and the incident angle of the sound source, which will be mathematically expressed by the following Equation 24.

$$c_a=\exp(-2*pi*f_c)$$

$$c_b=(1-c_a)*dc_g$$

$$y(n)=c_b*x(n)+c_a*y(n-1)$$

$$B\hat{}N_DSR(n)=y(n)+(1-dc_g)*x(n) \quad \text{[Equation 24]}$$

Herein, N=I, C.

In Equation 24, c_a and c_b are coefficients for determining cut-off of a filter and f_c is a cut-off frequency of the filter, dc_g is a normalization gain value in a dc frequency of the filter. According to an exemplary embodiment of the present invention, f_c and dc_g are adjusted to vary a low shelving filter and a low pass filter. f_c and dc_g are determined based on the distance and the incident angle of the sound source. According to an exemplary embodiment of the present invention, when the near-field renderers 148*a* and 148*b* of FIG. 19 are replaced by the BFS filter of the frequency domain according to the exemplary embodiment of Equation 21, a distance renderer of the frequency domain may be implemented.

The present invention has been described above through specific embodiments, but modifications or changes will be made by those skilled in the art without departing from the object and the scope of the present invention. That is, the present invention has described an exemplary embodiment of the binaural rendering on the audio signal, but the present invention may be similarly applied and extend not only to the audio signal, but also to various multimedia signals including a video signal. Accordingly, if it is easily inferred by those skilled in the art from the detailed description and the exemplary embodiment of the present invention, it is interpreted to be covered by the scope of the present invention.

What is claimed is:

1. An audio signal processing apparatus which performs binaural filtering on an input audio signal, the apparatus comprising:

a direction renderer configured to localize a direction of a sound source of the input audio signal; and a distance renderer configured to reflect an effect in accordance with a distance between the sound source of the input audio signal and a listener, wherein the distance renderer further configured to:

obtain information on a distance (an ipsilateral distance) and an incident angle (an ipsilateral incident angle) of the sound source with respect to an ipsilateral ear of the listener and information on a distance (a contralateral distance) and an incident angle (a contralateral incident angle) of the sound source with respect to a contralateral ear of the listener, determine an ipsilateral distance filter based on at least one of the obtained information of the ipsilateral distance and the ipsilateral incident angle, determine a contralateral distance filter based on at least one of the obtained information of the contralateral distance and contralateral incident angle, and filter the input audio signal with the determined ipsilateral distance filer and contralateral distance filter, respectively, to generate an ipsilateral output signal and a contralateral output signal.

2. The apparatus of claim 1, wherein the ipsilateral distance filter adjusts at least one of a gain and a frequency characteristic of the ipsilateral output signal and the contralateral distance filter adjusts at least one of a gain and a frequency characteristic of the contralateral output signal.

3. The apparatus of claim 2, wherein the ipsilateral distance filter is a low shelving filter and the contralateral distance filter is a low pass filter.

4. The apparatus of claim 1, wherein the ipsilateral distance, the ipsilateral incident angle, the contralateral distance, and the contralateral incident angle are obtained based on relative position information of the sound source with respect to a center of a head of the listener and head size information of the listener.

5. The apparatus of claim 1, wherein the distance renderer performs the filtering using the ipsilateral distance filter and the contralateral distance filter when a distance between the listener and the sound source is within a predetermined distance.

6. The apparatus of claim 1, wherein the direction renderer selects an ipsilateral direction filter based on the ipsilateral incident angle and selects a contralateral direction filter based on the contralateral incident angle, and filters the input audio signal using the selected ipsilateral direction filter and the contralateral direction filter.

7. The apparatus of claim 6, wherein the ipsilateral direction filter and the contralateral direction filter are selected from head related transfer function (HRTF) sets corresponding to different positions, respectively.

8. The apparatus of claim 6, wherein when relative position information of the sound source with respect to the center of the head of the listener is changed, the direction renderer additionally compensates for a notch component of at least one of the ipsilateral direction filter and the contralateral direction filter corresponding to the changed position.

9. The apparatus of claim 6, wherein the ipsilateral incident angle includes an azimuth (an ipsilateral azimuth) and an altitude (an ipsilateral altitude) of the sound source with respect to the ipsilateral ear and the contralateral incident angle includes an azimuth (a contralateral azimuth) and an altitude (a contralateral altitude) of the sound source with respect to the contralateral ear, and the direction renderer selects the ipsilateral direction filter based on the ipsilateral azimuth and the ipsilateral altitude and selects the contralateral direction filter based on the contralateral azimuth and the contralateral altitude.

10. The apparatus of claim 9, wherein the direction renderer obtains head rotation information of the listener and the head rotation information of the listener includes information on at least one of yaw, roll and pitch of the head of the listener, calculates a change of the ipsilateral incident angle and the contralateral incident angle based on the head rotation information of the listener, and selects the ipsilateral direction filter and the contralateral direction filter based on the changed ipsilateral incident angle and contralateral incident angle.

11. The apparatus of claim 10, wherein when the head of the listener rolls, any one of the ipsilateral altitude and the contralateral altitude is increased and the other one is decreased, and the direction renderer selects the ipsilateral direction filter and the contralateral direction filter based on the changed ipsilateral altitude and contralateral altitude.

12. An audio signal processing method which performs binaural filtering on an input audio signal, the method comprising:

obtaining information on a distance (an ipsilateral distance) and an incident angle (an ipsilateral incident angle) of a sound source with respect to an ipsilateral ear of the listener;

obtaining information on a distance (a contralateral distance) and an incident angle (a contralateral incident angle) of the sound source with respect to a contralateral ear of the listener;

determining an ipsilateral distance filter based on at least one of the obtained information of the ipsilateral distance and the ipsilateral incident angle;

determining a contralateral distance filter based on at least one of the obtained information of the contralateral distance and the contralateral incident angle;

filtering the input audio signal by the determined ipsilateral distance filter to generate an ipsilateral output signal; and filtering the input audio signal by the determined contralateral distance filter to generate a contralateral output signal.

* * * * *